US005370567A

United States Patent [19]

Glasa

[11] Patent Number: 5,370,567

[45] Date of Patent: Dec. 6, 1994

[54] DEVICE FOR THE INFLATION OF MORE PARTICULARLY A CONTAINER OR A FLOATING BODY OF A PIECE OF LIFESAVING EQUIPMENT

[75] Inventor: Stefan Glasa, Hamburg, Germany

[73] Assignee: Bernhardt Apparatebau GmbH u. Co., Wedel/Holstein, Germany

[21] Appl. No.: 947,270

[22] Filed: Sep. 18, 1992

[30] Foreign Application Priority Data

| | | | |
|---|---|---|---|
| Sep. 28, 1991 | [DE] | Germany | 9112117 |
| Nov. 11, 1991 | [DE] | Germany | 9113897 |
| Nov. 11, 1991 | [DE] | Germany | 9113940 |
| Nov. 12, 1991 | [DE] | Germany | 9114026 |

[51] Int. Cl.[5] ..... B67B 7/24

[52] U.S. Cl. ..... 441/95; 441/94; 222/5

[58] Field of Search ..... 441/90, 88, 92–95; 222/5, 54, 81, 88, 83.5; 169/19; 137/67, 68.1

[56] References Cited

U.S. PATENT DOCUMENTS

| | | | |
|---|---|---|---|
| 2,675,143 | 4/1954 | Seemann | 441/95 |
| 2,894,658 | 7/1959 | Spidy | 222/5 |
| 3,997,079 | 12/1976 | Niemann | 441/95 |
| 4,475,664 | 10/1984 | Mackal | 441/95 |
| 4,498,604 | 2/1985 | Mackal | 441/95 |
| 4,946,067 | 8/1990 | Kelsall | 222/5 |

FOREIGN PATENT DOCUMENTS

| | | |
|---|---|---|
| 2418433 | 8/1976 | Germany . |
| 2715132 | 11/1980 | Germany . |
| PCT/US82/-00731 | 5/1982 | WIPO . |

*Primary Examiner*—Robert J. Oberleitner
*Assistant Examiner*—Clifford T. Bartz
*Attorney, Agent, or Firm*—Kelly, Bauersfeld & Lowry

[57] ABSTRACT

A device (100) is provided for inflating, more particularly, a container or a floating body of a piece of lifesaving equipment with pressure gas from a pressure gas container (11) sealed with a diaphragm (14). The pressure gas container, within the area of a container neck (12), has an external thread (13) which can be screwed into a receiving aperture (15) in a housing (10). The gas content of the container (11) is released by opening the diaphragm (14) with the aid of an opening striker (24) disposed in the housing which may possibly be movable by means of a hand lever and by the force of a spring element against the diaphragm (14). The spring element in a pretensioned position, is retained with the aid of an automatic element (35) that loses its solidity in water. The pressure gas container (11) can be screwed into the receiving aperture (15) of the housing while simultaneously pretensioning the spring element.

29 Claims, 12 Drawing Sheets

11
12
13
15
16
400
19
15a
418
441
420
10
448
17
445
17a
446
444
447
423
440
422
449
415a
442
467
424
437
425
433
427
421
462
426
431
461
468
459
455
464
457
453
10a
456
454a
10b
458

DEVICE FOR THE INFLATION OF MORE PARTICULARLY A CONTAINER OR A FLOATING BODY OF A PIECE OF LIFESAVING EQUIPMENT

The present invention relates to a device for the inflation of more particularly a container or a floating body of a piece of lifesaving equipment with pressure gas from a pressure gas container sealed by means of a diaphragm. The pressure gas container, within the area of a container neck, is provided with an external thread and which can be screwed into a receiving aperture in a housing which is provided with a corresponding internal thread. The gas content of the container is released by the diaphragm being opened with the aid of an opening striker disposed in the housing. The opening striker may be displaced by means of a hand lever and by the force of a spring element toward the diaphragm, in which case the spring element is retained in the pretensioned position with the aid of an automatic element that loses its solidity in water.

BACKGROUND OF THE INVENTION

Automatic devices are known which comprise a basic body into which the pressure gas cylinder is screwed. In addition, a second, separate part is available in which a spring element is fitted which is tensioned by a screwing-in or plugging together operation and which produces the necessary impetus force so as, by means of a pertinent lever force, after the insertion of a tablet which dissolves in water, to drive a pointed striker through the sealing diaphragm for opening the pressure gas cylinder (DE-AS 27 15 132).

The impetus force to be employed here is relatively great. Moreover, the pretensioning force must, from the spring deflection, in dependence of the pressure gas cylinder opening striker, be fairly accurately harmonized or synchronized. In the event of the clamping sleeve not having been screwed in completely, it may happen that the pressure gas cylinder is not opened at all or only incompletely.

It is likewise necessary for the pressure gas cylinder to be screwed in completely as well as with a certain pretension so as to render a perfect functioning possible. Vibrations or frictional influences due to external actions or effects must not detrimentally affect the pressure gas cylinder in its screwed coupling with the body of the piece of equipment since the possibility of a detachment and, with this, a jeopardizing of the safety could arise.

The clamping sleeves for the spring element are separate components which, when being inserted, especially in a timewise limited hazardous situation, may be inadvertently lost or become damaged or be subject to contamination. All these are factors which endanger the safe functioning of such known automatic devices.

In contrast thereto, the problem of the present invention is to put a device of the type stated at the beginning safely into operation in as simple a fashion as possible and involving few operating steps. It is intended, moreover, to make it possible to provide only one housing part possessing as small as possible dimensions, low weight and rendering an inexpensive fabrication possible in order to rule out the aforementioned disadvantages which known devices are subject to.

This technical problem is solved by means of the features characterized in the claims.

SUMMARY OF THE INVENTION

In this case the solution consists in that, by the screwing in of the pressure gas container into the housing, the pretensioning of the spring element is possible to be effected simultaneously and that all the necessary functions are achieved solely and immediately with the screwing in of the pressure gas cylinder. Due to the circumstance that the screwing-in operation of the pressure gas cylinder and the tensioning operation of the device are combined, it is ensured that an adequate tension is obtained at all times. Owing to the parallelity and linearity of the motional actions, it is additionally accomplished that friction is avoided that the highest tripping forces are achieved. In this connection, the screwing in is merely regarded as being the simplest form of placing the pressure gas cylinder neck into the equipment aperture. Insertion and securing in the style of the bayonet catch or an insertion and securing from the outside have the same effect as the stated screwing in.

Moreover, the constant distance between the point of the opening striker and the diaphragm during the entire tensioning and screwing-in operation ensures that the device operates reliably even when the pressure gas cylinder has not been screwed in completely and this irrespective of whether a lever force is employed or what type of lever is made use of.

According to a first embodiment it is provided that a shifting member is acted upon by the pressure gas cylinder in the form of a pressure gas container which tensions the spring constructed in the form of a pressure spring. If the tensioning is now effected by the screwing in of the pressure gas cylinder, the device is at all times tensioned as long as a pressure gas cylinder is screwed in.

Provision is made furthermore for the shifting member to possess, on its end located opposite to the front side, a pocket-like accommodation space or chamber for the automatic element and for the pocket-like accommodation chamber to have an opening for supporting a central bolt on the automatic element, in which case the central bolt, when released by the automatic element due to the action of the spring, acts upon the striking pin and brings about the opening of the pressure gas container. It is possible to achieve hereby that the tension of the device is capable of existing only when the automatic element is inserted. Thus, a warning is already given by the reduced torque when screwing the pressure gas container in. If additional provision is then made for the central bolt, in the pretensioned position, to be passed with its end located opposite its impact end out of the housing so as to indicate the tension state with the aid of e.g. an appropriate optical marking of the bolt end, an indication is achieved which shows the correct tension of the device.

In a second embodiment it is provided that the spring is disposed between the shifting member and a first surface of a plunger-like tensioning member that is guided so as to be longitunially displaceable in the housing in the longitudinal direction of the housing bore, and that a second surface of the tensioning member located opposite the first surface is supported on a two-armed lever which is swivelable about an axis that is integral with the housing, and that the two-armed lever possesses a tripping arm and an actuating arm, while the free end of the tripping arm is disposed so as to reach into the area of a pocket-like accommodation space or chamber for the automatic element and that, with the free end of the actuating arm, a central bolt disposed in the housing bore and carrying the opening striker can be acted upon, and that the second surface of the tensioning member is supported on the two-armed lever by means of a tensioning lever that can be swiveled about an axis which is integral with the housing. It is achieved hereby that, by the deflection of the pretensioning force directed into the housing interior applied by the spring into the tensioning member via the tensioning lever and the two-armed lever, said pretensioning force is applied deflectedly onto the central bolt so that the two-armed lever, when it is released by the automatic element, swivels about its housing-integral axis and, with the aid of the central bolt, thrusts or knocks the opening striker mounted thereupon through the opening diaphragm so that the pressure gas is able to instantaneously enter into the interior of the housing. Furthermore, this arrangement possesses the advantage of it being achievable for the tension of the device being possible to exist only when the automatic element is inserted. By the layout of the piece of equipment it is accomplished that a warning is already given by the reduced torque when the pressure gas container is screwed in. If the complete screwing-in of the pressure gas cylinder is then nevertheless effected, the device may possibly be tripped by the opening striker piercing the diaphragm so that an acoustic signal is provided as well. If required, additional means will be provided which render a tensioning of the device impossible when no automatic element has been inserted. Advantageously, additional provision is also made for the central bolt in the pretensioned position to be made to project out of the housing with its end located opposite the end on which the opening striker is mounted for indicating the state of the tension, by means whereof, e.g. with the aid of an appropriate optical marking on the bolt extremity, an indication is obtained showing the correct tension of the device.

In a third embodiment it is provided that a shifting member is acted upon by the pressure gas cylinder having the form of a pressure gas container which tensions the spring which is constructed in the form of a pressure spring. When the tensioning is now effected by the screwing in of the pressure cylinder, with a screwed-in pressure gas cylinder the device is always reliably tensioned. In this case the screwing-in bore is pulled out of the housing due to the reversal of the kinematics, while the pressure gas cylinder rotates during the screwing-in operation without, however, moving into the housing, but is supported on the housing surface.

It is furthermore provided that the spring is disposed between a radial surface of the shifting member and a first surface of a tensioning member that is guided so as to be longitudinally displaceable in the longitudinal direction of the housing bore, and that a second radial surface of the tensioning member which is located opposite the first radial surface, is supported by a two-armed lever which is swivelable about an axis which is integral with the housing, and that the two-armed lever has a tripping arm and an actuating arm, while the free end of the tripping arm is disposed in such a way as to reach into the area of a pocket-like accommodation space for the automatic element and that, with the free end of the actuating arm, the second radial surface of the tensioning member can be acted upon, the tensioning member has a third radial surface which is located opposite the first radial surface, with the aid of which a central bolt disposed in the housing bore and carrying the opening striker can be acted upon. It is achieved hereby that the pretensioning force generated by means of the shifting member and applied to the tensioning member by the spring, is applied to the two-armed lever which, when the two-armed lever is released by the automatic element, swivels about its housing-integral axis and releases the tensioning member which, with the aid of the central bolt, thrusts or knocks the opening striker mounted thereupon through the opening diaphragm so that the pressure gas is able to instantaneously enter the housing interior. In addition, this arrangement offers the advantage that it is possible to achieve that the tension of the device is possible only when the automatic element is inserted. By means of the layout of the device it is achieved that a warning will already be given by the reduced torque when the pressure gas container is screwed in. If the complete screwing-in of the pressure gas cylinder is then nevertheless effected, the device is possibly tripped in that the opening striker pierces the diaphragm so that an acoustic signal is triggered as well. If required, additional means will be provided which render a tensioning of the device impossible if no automatic element has been inserted. Advantageously, additional provision is also made for the central bolt, in the pretensioned state, to be made to project from the housing with its end that is located opposite the end which carries the opening striker for the indication of the state of tension, in which connection e.g. by means of an appropriate marking of the bolt extremity, an indication is achieved which shows the correct tension of the device.

In a fourth embodiment of the device, the control of the tripping mechanism of the opening striker is effected with the aid of the automatic element which loses its solidity in water, which, by preference, is disposed in the housing in the form of a tablet and which interacts with two one-armed levers that are swivelably arranged in the housing and this in such a way that, when the automatic element is dissolved, the opening striker which is subjected to spring tension is released in such a way that its point penetrates the diaphragm of the pressure gas container so as to release the pressurized gaseous medium. By using two actuating levers that interact it is ensured that the lever which acts together direct with the automatic element during the tensioning operation, is brought forward to the automatic element in a friction-free manner in order to prevent premature damage being inflicted to the automatic element or that, by the reduction of the friction, one contributes to the preservation of the solidity of the automatic element in such a way that the automatic element is then, by the action of the water, capable of fully developing, i.e. of fully losing its solidity in order to actuate the tripping mechanism of the opening striker.

The employment of two one-armed levers is advantageous, one of which acts as actuating lever for the opening striker and the other lever interacts with the automatic element as tripping lever. In this additional embodiment, only one of the two levers interacts with the automatic element, on the other hand, both levers can be moved into a locking position to which reference will be made in greater detail hereinafter. While one of the two levers acts as an actuating lever, the second lever possesses the function of a tripping lever which, with its free end, reaches into the area of a pocket-like accommodation space or chamber in the housing for the automatic element, while the actuating lever, with its free end, serves to lock with the actuating lever and interacts with a transverse pin on the shank of the opening striker, while the actuating lever, in the locking position, is supported together with the tripping lever on the housing wall. This reciprocal locking between the actuating lever and the tripping lever is continued until the actuating lever assumes a position in which the actuating lever no longer abuts against the housing and, consequently, with the simultaneous release of the opening striker that is subject to spring pressure, is able to swivel freely. By means of the pressure gas cylinder in the form of a pressure gas container, a shifting member is acted upon in the device which tensions the spring constructed in the form of a pressure spring. If the tensioning is now effected by the screwing in of the pressure gas cylinder, the device is at all times reliably tensioned when a pressure gas cylinder is screwed in. In the process, due to a reversal of the kinematics, the screwing bore is drawn out of the housing while the pressure gas cylinder rotates during the screwing-in operation without, however, moving into the housing, but is supported on the housing surface. The tensioning spring is preferably disposed between a radial surface of a tensioning member that is guided in the housing so as to be longitudinally displaceable in the longitudinal direction of a housing bore constructed in the latter, the tensioning member being constructed in such a way that a central bolt disposed in the housing bore and carrying the opening striker can be acted upon. It is achieved hereby that the pretensioning force generated with the aid of the shifting member applied by the spring to the tensioning member is applied to the actuating lever which, when the tripping lever is released by the automatic element, swivels about its housing-integral axis, while the tensioning member is simultaneously released, which, by means of a central bolt, thrusts or knocks the opening striker mounted thereupon through the opening diaphragm so that the pressure gas is able to instantaneously enter the interior of the housing. The arrangement in this device is then preferably additionally such that it can be achieved that the tension of the device is possible only when the automatic element has been inserted. In addition, it is provided that the central bolt, in the pretensioned position, is made to project from the housing with the end of its shank that is located opposite the end which carries the opening striker in order to indicate the state of tension, in which connection e.g. this end projecting from the housing is provided with an appropriate optical marking or with a color coating in order to visibly indicate to the outside that a correct tension exists.

In a fifth embodiment of the device the control of the tripping mechanism of the opening striker is effected with the aid of the automatic element which loses its solidity in water, which is preferably disposed in the housing in the form of a tablet and which interacts with a one-armed lever swivelably disposed on a tensioning member, and this in such a way that, when the automatic element is dissolved, the spring kept under pretension by means of a lifting axis disposed on the lever is released when the lever is swiveled so that the same impinges upon two bearing arms of the central bolt and moves the same upwardly together with the opening striker mounted thereupon so that its point pierces the diaphragm of the pressure gas container in order to release the pressurized gaseous medium. By the use of the lever of the tripping lever and of the lifting axis, which interact with the automatic element, it is ensured that the lever which interacts with the automatic element direct, when tensioned, is moved toward the automatic element in a friction-free manner so as to prevent that the automatic element is prematurely damaged or that, by the reduction of the friction, a contribution is made to preserve the solidity of the automatic element in such a way that the automatic element is then able to fully develop by the action of water upon it, i.e. is able to completely lose its solidity in order to actuate the tripping mechanism of the opening striker.

Provision is made by preference for a central bolt carrying the opening striker to be disposed within the section of the housing bore which has at least one bearing arm projecting at right angles relative to the direction of motion of the opening striker which, in the event of the device being tripped, can be acted upon by the spring. By using the lever in the form of a tripping element and the central bolt as an actuating element, it is ensured that solely the lever interacts with the automatic element direct, while the spring, without any deflection, is capable of acting on the opening striker direct.

Provision is made furthermore for the tensioning member to be fitted with an angled, arm-like extension member in which a chamber, cavity, recess or the like for accommodating the automatic element has been constructed and which possesses an entry opening for the bearing section of the one-armed lever, in which case the lever, as tripping arm, when released by the automatic element, releases the spring with the aid of the lifting axis and the spring, by acting upon the central bolt, brings about the opening of the diaphragm of the pressure gas container.

Hereby, due to the joint movement of the lever and of the automatic element, all friction is avoided during the tensioning operation.

Provision is made moreover for a covering member disposed so as to be rotatable about a housing-integral axis to possess a covering plate which covers the accommodation chamber for the automatic element in a normal position and which, for the insertion of an automatic element, can be swiveled into a swung-out position, thus unblocking the accommodation chamber, and for the covering member to possess a blocking arm which, in a tensioned basic position of the device when the pressure gas container is not screwed in, can be swiveled into a blocking arm receiving recess in the extension member. Hereby it is achieved that operating errors of the device are practically impossible. For a filling of the accommodation chamber is then possible only when the pressure gas container is unscrewed, whereby the user is compelled to replace the possibly empty container. If, subsequent to the filling operation, the tension of the device has been forgotten due to the pressure gas container having been screwed in, it is not possible to see the automatic element since it is still covered. Moreover, provision is made for the central bolt, in the pretensioned position, to be made to project from the housing with that end of its shank which is located opposite the end that carries the opening striker for indicating the state of the tension, in which case e.g. this extremity projecting from the housing is provided with a marking, such as e.g. an appropriate optical marking or with a color coating so as to visibly indicate to the outside that a correct tension exists.

That is why a control of all functions is possible.

In order to simplify the assembly of the device, provision is preferably made for the section of the housing bore wherein the tensioning member is guided, to be closed to the outside with the aid of a clamping member which has a limit stop on the side of the housing surface for the spring.

In all the embodiments it is provided that the accommodation chamber in the housing intended for holding the automatic element is provided with a pressure balance venting aperture as well as with a water entry aperture.

Altogether a device is thus provided which is constructed just as simply as it is reliable in operation.

Advantageous designs and expedient further developments are characterized in the subclaims.

BRIEF DESCRIPTION OF THE DRAWINGS

Embodiment examples of the invention are explained in detail hereinafter with the aid of the drawings. Thus

DETAILED DESCRIPTION OF THE PREFERRED EMBODIMENTS

Figure 1:
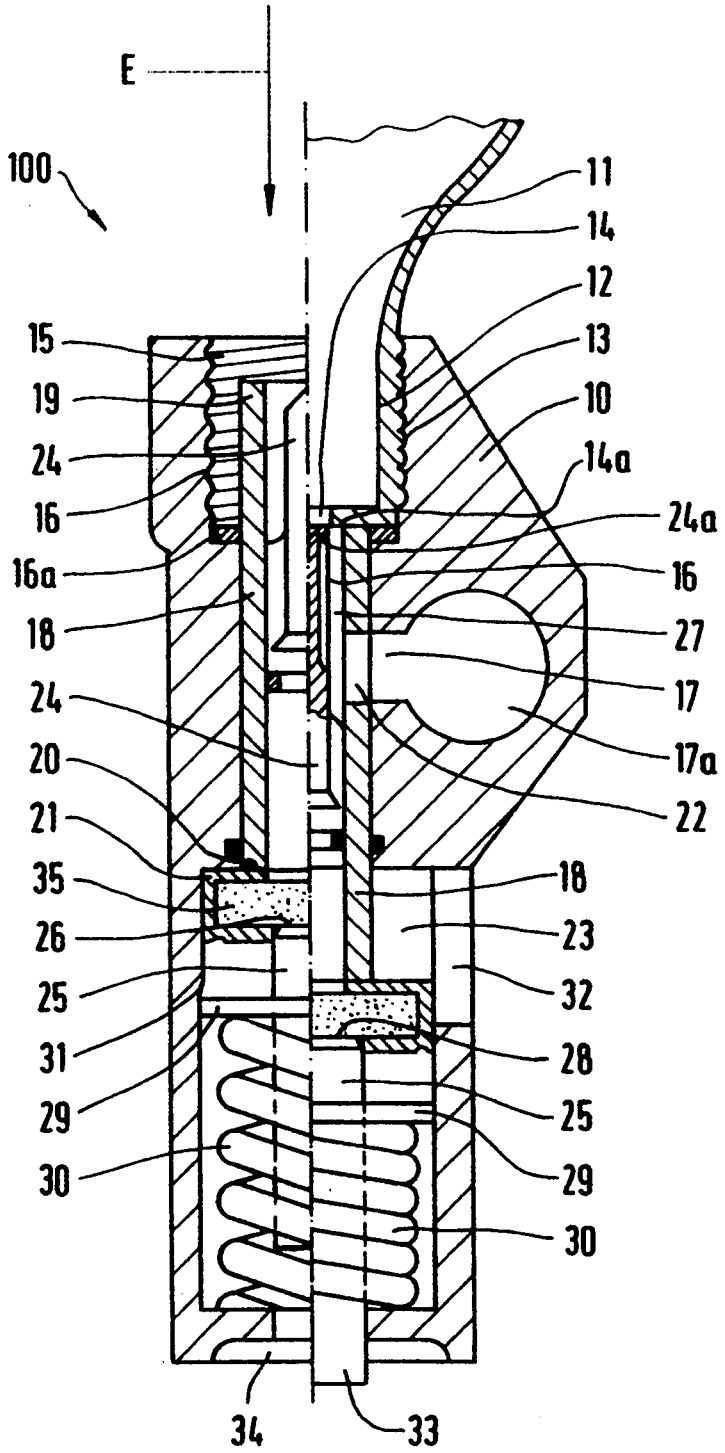
FIG. 1 shows, in a vertical sectional representation, a device for inflation.

In the FIG. 1, a device 100 for inflating a floating body (not shown) of a piece of lifesaving equipment (likewise not shown) with pressure gas is illustrated, and this in a longitudinal section, in which the left-hand half of the section shows the device in the non-tensioned state with the pressure gas container not screwed in, whereas the right-hand half depicts the device with a pressure gas container 11 screwed into the housing 10. The pressure gas container 11, which is constructed in the form of a pressure gas cylinder, is, within the area of the container neck 12, provided with an external thread 13 and sealed with the aid of a diaphragm 14. In a housing bore 15 which, in its upper part, is provided with an internal thread 16 and with a seal 16*a* within its terminal area and which, by means of a branch duct 17 and an air connection piece indicated at 17*a*, is connectable to a piece of lifesaving equipment to be inflated (not shown in the drawing) the shifting member 18 is disposed which is constructed in the form of a sleeve and which reaches with its one front side 19 into the area of the upper area of the housing bore 15 with the internal thread 16 and thus, when the pressure gas container 11 is screwed in, is acted upon by the front side 14*a* of the container neck 12. On the oppositely located end 20 of the shifting member 18, a pocket-like accommodation chamber 21 for the automatic element 35, which is normally in the form of a tablet 122 and which disintegrates in water, is disposed. The accommodation chamber 21 is in this case to be found in an enlarged part of the housing bore 15 so that the shifting member 18 is retained so as to be captive in the housing 10.

In the shifting member 18 which is constructed in the form of a sleeve, the opening striker 24 is mounted so as to be displaceable relative to the shifting member 18, which, in its normal position, reaches into the area of the front side 19 of the sleeve-like shifting member and can be urged by the central bolt 25 out of the sleeve-like shifting member 18 through the diaphragm 14. In this case the central bolt 25 is disposed in the enlarged section 13 of the housing bore 15 in such a way that, when the automatic element 35 disintegrates, while reaching through opening 26, in the interior 27 of the sleeve-like shifting member, with its impact end 28, when impinging upon the end of the opening striker 24, moves the latter against the diaphragm 14. In this case the central bolt 25 is, within its area allocated to the impact end 28, provided with an intermediate plate 29 corresponding to the cross-section of the enlarged part 23 upon which a pressure spring 30 is supported which is at the same time supported on the housing 10. The arrangement of the plate 29 and the pressure spring 30 is in this case such that, when the central bolt is moved in the screwing-in direction of the pressure gas container 11, the pressure spring 30 is compressed and pretensioned. Since the pressure gas container 11, during the screwing-in operation, displaces the shifting member 18 in the screwing-in direction, the same acts, with the aid of the automatic element 35, upon the central bolt 25 which, for its part, is displaced in the screwing-in direction so that the pressure spring 30 is pretensioned, as is illustrated in the right-hand portion of FIG. 1.

In this case the operation proceeds as follows. In the non-tensioned operational position of the device depicted in the left-hand portion of the FIG. 1, the intermediate plate 29 is supported on a shoulder 31 in the enlarged part 23 of the housing bore. As is then depicted in the right-hand portion of FIG. 1, when the pressure gas container 11 is screwed into the housing bore 15 with the aid of the shifting member 18, which, just like the opening striker 24, which acts as striking pin, is also supported on the accommodation chamber 21 of the automatic element 35, the intermediate plate 29 is pressed downwardly and the same pretensions the pressure spring 30. The central bolt 25 now bears against a tablet inserted through an aperture 32 as automatic element 35 within the accommodation chamber 21.

When the pressure gas cylinder 11 is screwed into the internal thread 16, the shifting member 18 and, with it, the opening striker 24, is downwardly displaced while resting on the accommodation chamber casing 21 so that the spring 30 is tensioned. The free end 33 of the central bolt 25 located opposite the impact end 28, when the pressure gas cylinder 11 is screwed in completely, projects through an opening 34 from the lower housing bottom of the housing 10 and serves as optical control element in order to render the position of readiness of the device perceptible. When the tablet 122 disintegrates due to the penetration of water through the opening 32 in the housing 10, the central bolt 25 is able to impel the opening striker 24 within the shifting member 18 upwardly so that the point of the opening striker 24 penetrates through the sealing diaphragm 14 of the pressure gas container 11 and opens the latter so that the gas is able to issue from the pressure gas cylinder through a slit 22 in the shifting member 18 into the branch duct 17 which communicates with the non-depicted floating body in a known manner.

Figure 2:
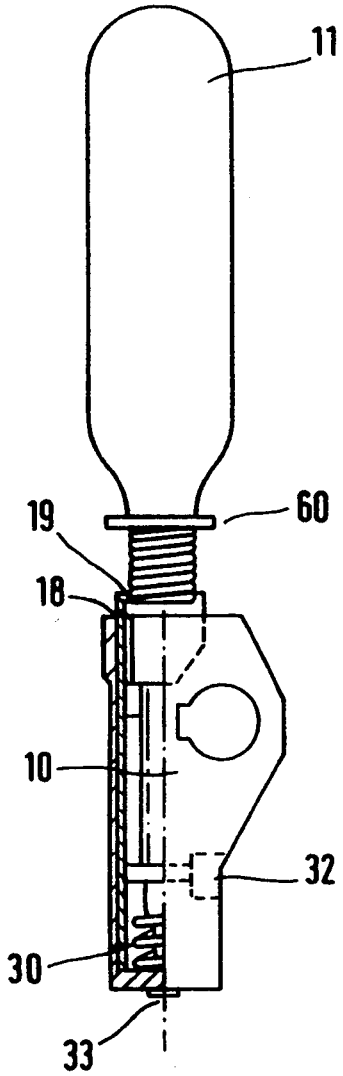
FIG. 2 shows, in a partially sectional representation, a further embodiment of the device.

In FIG. 2 a further embodiment of the device is illustrated. On this occasion all the essential features of the device 100 described in the foregoing do correspond, however, the shifting member 18*a* in the form of a sleeve that is not disposed within the housing aperture 15, but instead it encloses the same and, moreover, projects from the housing 10. In this case the pressure gas container 11 is provided with a recessed ring 60, to be more precise, on the container neck 12 above the external thread 13 which, during the screwing-in operation, acts upon the shifting member 118. The latter is moved by the screw-in operation in the direction of the screwing in and in this fashion pretensions the pressure spring 30.

Due to the ratio of the diameters of threads, pressure gas cylinders and gas chamber housing it is possible for a powerful pretensioning to be achieved with the exertion of but little manual force. The pretension force presses continuously on the screwed connection of housing and pressure gas cylinder so that a loosening owing to vibrations or by other external influences is avoided.

Figure 3:
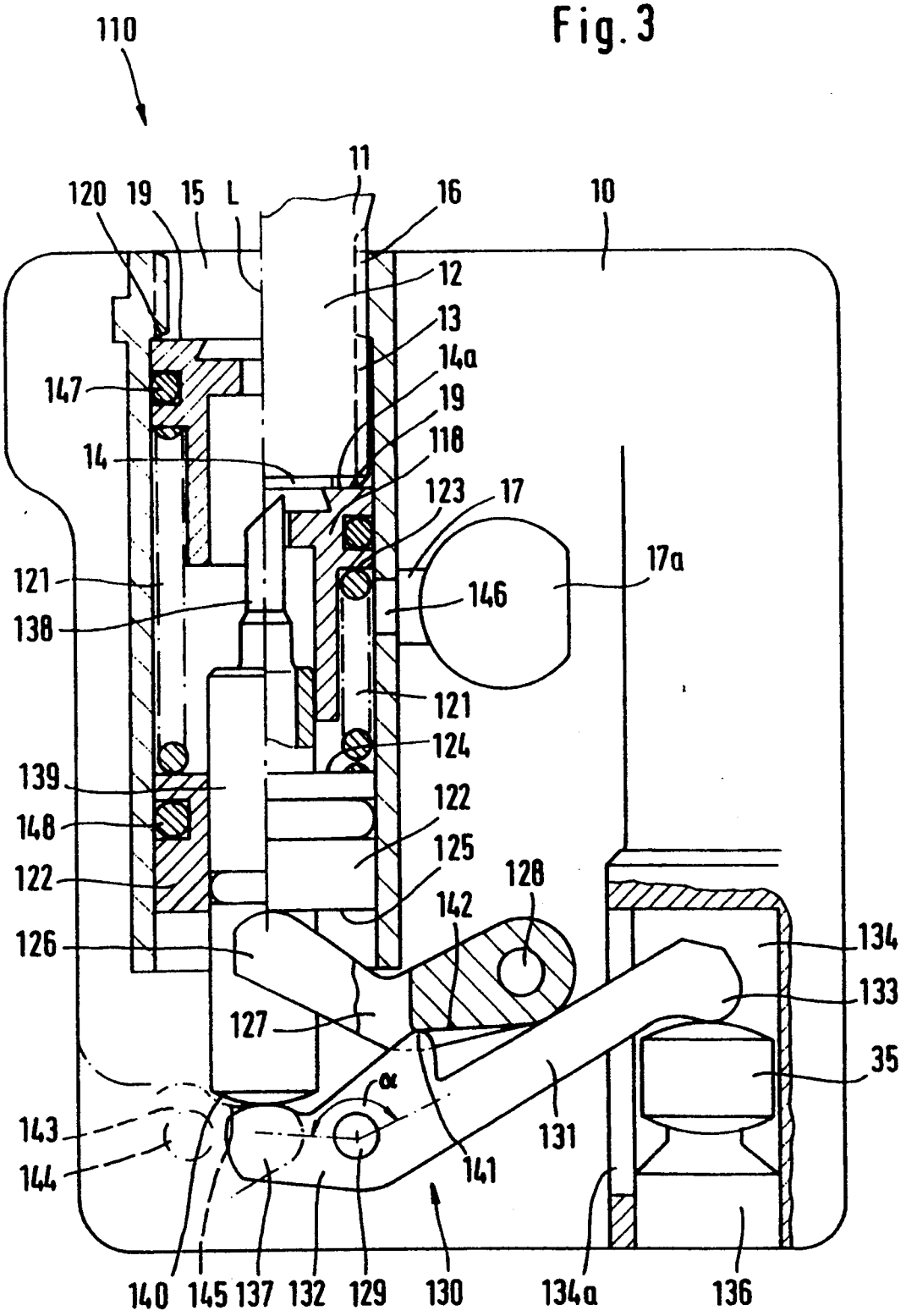
FIGS. 3 through 6 show four further embodiments of the device in pertinent representations.

In FIG. 3, a device 110 for inflating a floating body not shown in the drawing of a likewise non-depicted piece of lifesaving equipment with pressure gas is illustrated and this in longitudinal section, in which the left-hand half of the section shows the device in the non-tensioned state with the pressure gas container not screwed in, whereas the right-hand half shows the device with a pressure gas container 11 screwed into the housing 10. The pressure gas container 11, which is constructed in the form of a pressure gas cylinder, is, within the area of the container neck 12, provided with an external thread 13 and sealed with the aid of a diaphragm 14. In a housing bore 15 which, in its upper part, is provided with an internal thread 16 and, within the terminal area of the same, with a sealing **16*a* that can be made to communicate via a branch duct 17 and an air connection piece indicated at 17*a* with a piece of lifesaving equipment to be inflated and not shown in the drawing, the shifting member 118 is disposed which is constructed in the form of a sleeve and which reaches with one of its front sides 19 into the area of the upper part of the housing bore 15 with the internal thread 16 and is, when the pressure gas container 11 is screwed in, acted upon by the front side 14*a* of the container neck 12**.

The shifting member 118 which is guided so as to be longitudinally displaceable in the housing bore 15 which is secured against dropping out from the housing 10 by means of a step 120 in the housing bore 15, is, by means of a spring 121 supported with respect to a tensioning member 122 which is likewise guided so as to be longitudinally displaceable in the housing bore 15, while the spring 121 is disposed between a radial surface 123 of the shifting member 118 and a first radial surface 124 of the tensioning member 122. The surface 123 located opposite the first radial surface 24 of the tensioning member 122 which possesses the configuration of a cylindrical member, can be supported on the free terminal portion 126 of a tensioning lever 127 which is swivelable about a housing-integral axis 128. The axis 128, which is vertical to the longitudinal axis L of the housing bore 15, does in this case lie outside the housing bore 15, while the free end 126 projects into the housing bore 15 in such a way that a contact between the free end 126 of the tensioning lever 127 and the surface 125 of the tensioning member 122 takes place. Below the tensioning lever 127, a two-armed lever 130 which is swivelable about a housing-integral axis 129 is disposed, whose axis 129 is disposed in the housing at a distance to the axis 128 of the tensioning lever 127. The lever 130 possesses two arms, viz. a tripping arm 131 and an actuating arm 132, which enclose an angle alpha that amounts to approximately 160° in the embodiment example, in which case any other angle alpha is possible when the following function is realized. The free end 133 of the tripping arm 131 reaches into the area of the pocket-like accommodating chamber 134 for the automatic element 35 which normally is in the form of a tablet which disintegrates in water. The pocket-like accommodation chamber 134 has a closable insertion aperture 136 for the automatic element 35, while the automatic element 35 is supported by means of a closure that is merely indicated. When the device 110 is tensioned, the free end 133 of the tripping arm 131 is supported on the automatic element 35, while the free end 137 of the actuating arm 132 projects into the housing bore 15.

In the shifting member 118, which is constructed in the form of a sleeve, the opening striker 138 is disposed so as to be displaceable with respect to the shifting member which, in its normal position, reaches into the area of the front side 19 of the sleeve 118 and is mounted upon a central bolt 139 with which it may be integral. The central bolt 139 is disposed paraxially to the longitudinal axis L of the housing bore 15 inside the same and reaches through the tensioning member 122 within which it is slidingly guided. In the tensioned state of the device, the central bolt 139 rests with a lower surface 140 located opposite the opening striker 138 upon the free end of the actuating arm 132, in which case the free surface 140 may also be constructed in the form of a step of the central bolt 139 when the central bolt is made to project from the housing 10 in order to form an indicating means.

Furthermore, the two-armed lever 130 is provided with an additional arm or cam 141 which bears against a stop 142 that is constructed on the tensioning lever 127, the arrangement of the cam 141 and the construction of the stop surface 142 being selected in such a way that the contact of the cam 141 on the stop 142 is maintained even when the tensioning lever 127 is swiveled about its axis 125 while subject to the action of the spring 121 by means of the tensioning member 122 via a pertinent path in order to swivel the two-armed lever 130 along with it clockwise about the axis 139 when the same is released by the automatic element 35.

In addition, a swivel lever 143 is provided which is merely indicated in FIG. 3 and which can be swiveled about a housing-integral axis 144 and which, with a cam 145, rests on the surface 140 of the central bolt 139 parallel to the free end 137 of the actuating arm 132 and which is connected with a known hand lever that is not shown in the drawing for manual tripping.

In this case the device 110 functions as described below. When the device 110 depicted in the non-tensioned state in the left-hand part of FIG. 3 is screwed in, the shifting member 118 is displaced in the screwing-in direction, as is shown in the right-hand part of FIG. 3 and thus pretensions the spring 121 which is supported on the tensioning step 120 which is not displaced during the screwing-in operation. The tensioning member 122 rests upon the tensioning lever 127 which, in turn, by means of its contact surface 142, rests upon the cam 141 of the two-armed lever 130. The latter is, with its tripping lever 131, supported on the automatic element 35, while the actuating lever 132 acts upon the central bolt. Moreover, the opening striker 138 is mounted on the central bolt 139 which lies, with its point, direct within the area of the diaphragm 14. When the tablet which constitutes the automatic element 35 now disintegrates due to the penetration of water into the accommodation chamber 134 through a non-depicted aperture, the two-armed lever 130 is able to swivel clockwise about the axis 129, the swiveling path being rendered possible by the opening 134*a* which is reached through by the tripping arm 131. During the swiveling of the two-armed lever 130, which takes place instantaneously owing to the sudden disintegration of the automatic element 35, the free end 137 of the actuating lever 132 actuates the central bolt 139 so that the point of the opening striker 138 penetrates through the sealing diaphragm 14 of the pressure gas container 11 and opens the same so that the gas from the pressure gas cylinder is able to enter into the housing bore 15 and through a slit 146 in the shifting member 118 into the branch duct 17 which communicates with a non-depicted floating body in a manner known per se. In this case, both the shifting member 118 as well as the tensioning member 122 is provided with appropriate sealing rings 147,148 resting against the wall of the housing bore 15 in order to prevent an inadvertent escape of the pressure gas from the device or into other spaces or chambers thereof.

Following the unscrewing of the pressure gas cylinder 11, the initial position depicted in the left-hand portion of the drawing is reassumed, in which case, with the aid of a non-depicted spring between the housing 10 and the two-armed lever 130, its initial position shown in the drawing can be brought about so that a problem-free insertion of the tablet as automatic element 35 is made possible.

Figure 4:
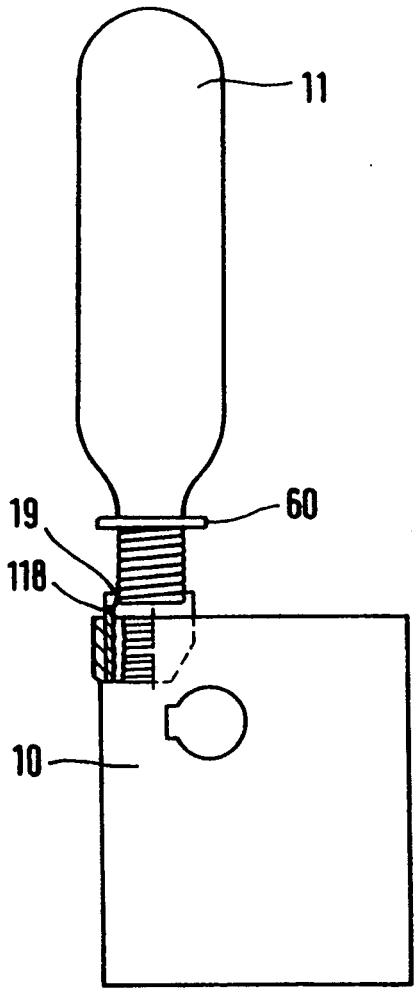

A further embodiment of the device is depicted in FIG. 4. On this occasion all the essential features correspond to the device 110 described in the foregoing, however, the shifting member 118 in the form of a sleeve is not disposed within the housing bore 15, instead it encloses the same and, in addition, it projects from the housing 10. The pressure gas container 11 is in this case provided with a recessed ring 60, to be more specific, on the container neck 12 above the external thread 13 which, during the screwing-in operation, acts upon the shifting member 118. By means of the screwing in the latter is moved in the screwing-in direction and thus pretensions the pressure spring.

On account of the ratio of the diameters of threads, pressure gas cylinder and gas chamber casing it is possible to obtain a powerful pretension with but little manual force. The pretension force presses continuously upon the screw coupling of housing and pressure gas cylinder so that a detachment due to vibrations or other external influences is prevented.

Figure 5:
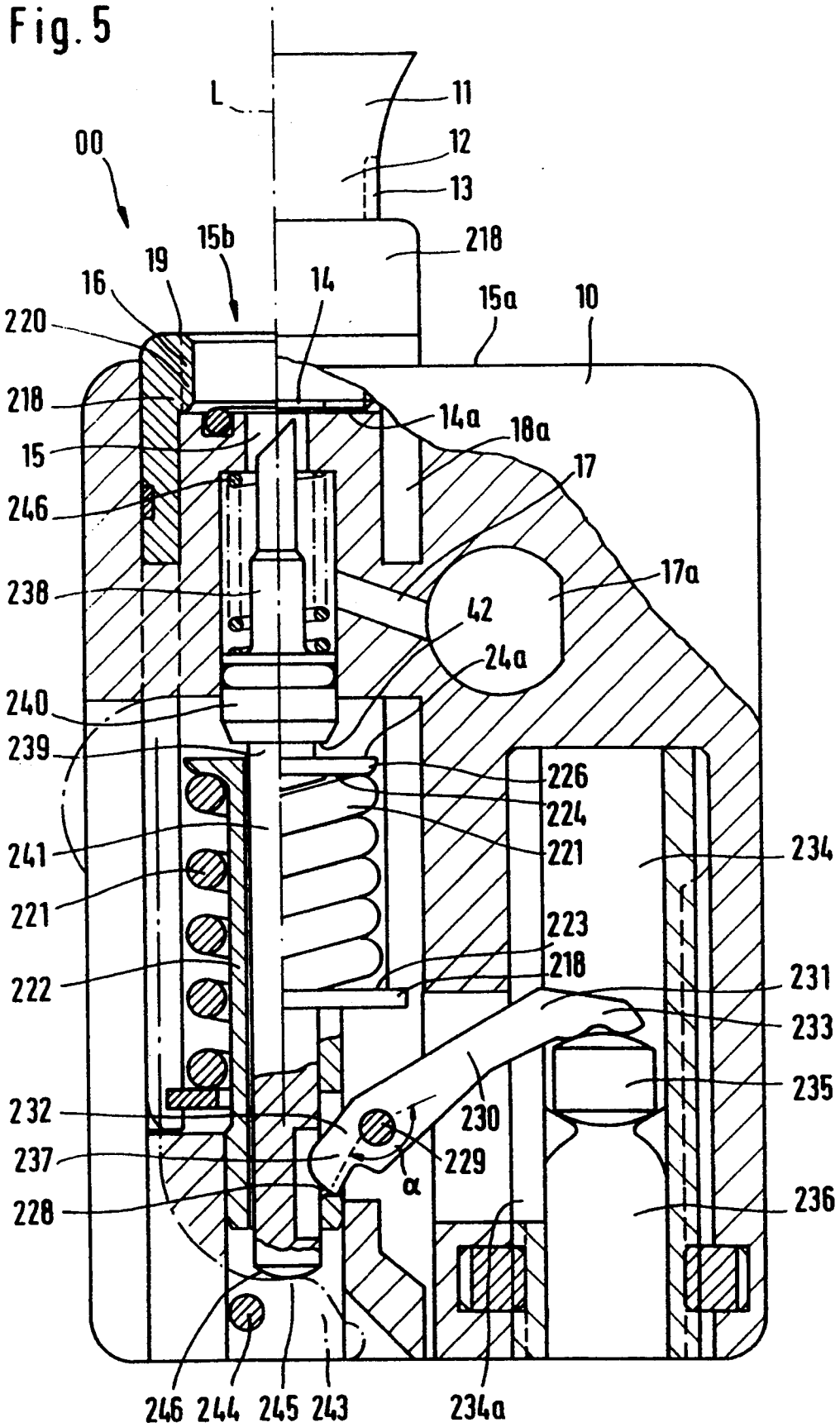

In FIG. 5, a further embodiment of the device 200 for inflating a floating body not shown in the drawing of a likewise non-depicted piece of lifesaving equipment by means of pressure gas is illustrated, and this in longitudinal section, in which the left half of the section shows the device in a non-tensioned state with the pressure gas container not screwed in, while the right half shows the device with a pressure gas container 11 screwed into the housing 10. The pressure gas container 11 which is constructed in the form of a pressure gas cylinder, is, within the area of the container neck 12, provided with an external thread 13 and sealed with the aid of a diaphragm 14. Within the area of a housing bore 15 possessing a recessed portion 15*b* within the housing entry area 15*a*, which, via a branch duct 17 and an air connection piece indicated at 17*a*, can be made to communicate with a non-depicted piece of lifesaving equipment to be inflated, the shifting member 218 is disposed which is constructed in the form of a sleeve which, within its upper part, is provided with an internal thread 16 and which projects with one of its front sides 19 over the area of the housing surface 15 surrounding the housing bore 15 and which is pulled out from the housing when the pressure gas container 11 is screwed into the sleeve-like shifting member 218, in which case the front side 14*a* of the pressure gas container 11 then rests upon the surface 15*b* of the recess when being screwed in.

The shifting member 218 which is guided so as to be longitudinally displaceable in a pertinent recess 218*a* and, by means of a step 220 in the housing bore 15, is secured against slipping through into the housing 10, is, by means of a spring 221, supported with respect to a tensioning member 222 which is likewise guided so as to be longitudinally displaceable in the housing bore 15, the spring 221 being in this case disposed between a radial surface 223 of the shifting member 228 and a first radial surface 224 of the tensioning member 222. The tensioning member 222 is comprised of a disk-like head 226 having a first surface 224 and a surface 224*a* located opposite the latter as well as of a shank 227 with a limit stoplike step 228 constructed thereupon.

Below the head 226, a two-armed lever 230 is disposed that is swivelable about a housing-integral axis 229 as to be parallel and at a distance from the longitudinal axis L of the housing bore 15 in the housing 210. The lever 230 has two arms, viz. a tripping arm 231 and an actuating arm 232 which, relative to each other, form an angle alpha which amounts to approximately 160° in the embodiment example, in which case any other angle alpha is also possible if the following function is realized. The free end 233 of the tripping arm 231 reaches into the area of a pocket-like accommodation chamber 234 for the automatic element 35, which normally is in the form of a tablet that disintegrates in water. The pocket-like accommodation chamber 234 possesses a closable inserting aperture for the automatic element 35, the automatic element being in this case supported with the aid of a merely indicated closure. When the device 200 is tensioned, the free end 233 of the tripping arm 231 is supported on the automatic element 35 while the free end 237 of the tripping arm 232 projects into the housing bore 15 and, in the tensioned state of the device, rests upon the step 228.

In the housing bore 15, opposite the housing bore 15, the opening striker 238 is displaceably disposed which, in its normal position, reaches into the area of the internal thread 16 inside the sleeve-like shifting member 218 and is mounted on a central bolt 239 with which it may be integral. The central bolt 239 is mounted paraxially to the longitudinal axis L of the housing bore 15 inside the same and reaches through the tensioning member 222, within which it is glidingly guided. The central bolt 239 which is comprised of a head member 240 carrying the opening striker 238 and a shank 241 glidingly guided in the tensioning member 222, in the tensioned state of the device, in which case, in the event of the device being triggered, the surfaces 224*a* and 242 impinge upon each other. The shank 227 of the tensioning member 222, on its free end, has the free radial surface 228 which may also be constructed in the form of a step when the central bolt is made to project with its end from the housing 10 in order to form an indicating means and rests upon the free end of the actuating arm 232.

Additional provision is made for a swiveling lever 243 merely indicated in FIG. 5 that is swivelable about a housing-integral axis 244 and which, with its cam 245, rests upon the lower surface 246 of the central bolt 239 and which is connected with a known hand lever not shown in the drawing for manual tripping.

On this occasion the device 200 functions as described in the following. When the device 200 illustrated in the left-hand portion of FIG. 5 is, in the non-tensioned state, screwed in, the shifting member 218 is displaced in the direction opposite to the screwing-in direction, i.e. pulled a distance out of the housing 10, as is depicted in the right-hand portion of FIG. 5 and thus pretensions the spring 221 which, during the screwing-in operation, rests upon the non-displaced tensioning member 222. The tensioning member 222 is supported by means of the step 228 on the two-armed lever 230. The same is, with its tripping lever 231, supported on the automatic element 35, while the actuating lever 232 retains the tensioning member 222. In this case the opening striker 238 is mounted on the central bolt 239 which, with its point 38*a*, lies directly within the area of the diaphragm 14. When the tablet which constitutes the automatic element 35 now disintegrates due to the penetration of water through a non-depicted aperture into the accommodation in chamber 234, the two-armed lever 230 is able to swivel clockwise about the axis 229, the swiveling path being rendered possible here by the opening 234*a* reached through by the tripping arm 231. When the swiveling of the two-armed lever 230 takes place, which, owing to the planned sudden disintegration of the automatic element 35, occurs instantaneously, the free end 237 of the actuating arm 232 releases the tensioning member 222 so that the tensioning member 222 knocks on the central bolt 239 and the point of the opening striker 238 penetrates through the sealing diaphragm 14 of the pressure gas container 11 and opens the same so that the gas from the pressure gas cylinder is able to enter the housing bore 15 and, through a slit not shown in the drawing in the shifting member 218, into the branch duct 17 which communicates in a manner known per se with a non-depicted floating body. In this case, both the shifting member 218 as well as the tensioning member 222, are possibly provided with appropriate sealing rings in order to prevent an inadvertent escape of the pressure gas from the device or into other spaces or chambers thereof.

Subsequent to the pressure gas cylinder 11 having been unscrewed, the initial position illustrated in the left-hand portion of the drawing is reassumed, whereby, with the aid of the spring 246 between the housing 10 and the opening striker 239, the initial position of which is shown in the drawing can be brought about so that a problem-free insertion of the tablet as automatic element 35 is made possible.

Figure 6:
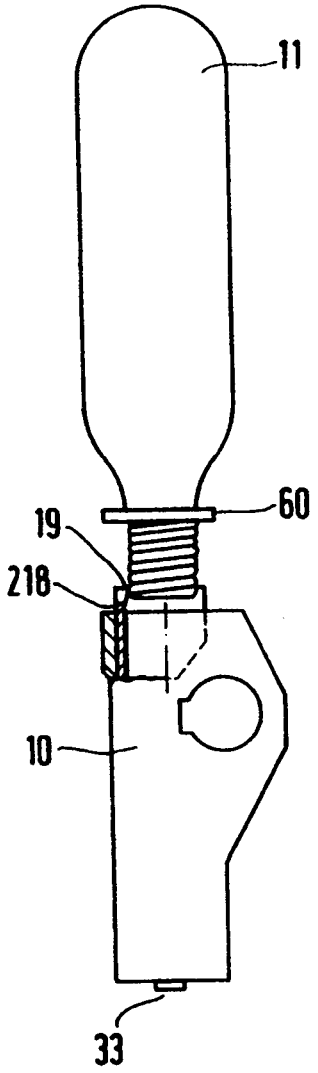

A further embodiment of the device is depicted in FIG. 6. On this occasion, all the essential features correspond to the device 200 described hereinbefore, however, the shifting member 218 in the form of a sleeve is not disposed within the housing bore 15, instead it encloses the same and, in addition, it projects from the housing 10. In this case the pressure gas container 11 is provided with a recessed ring 60, to be more precise, on the container neck 12 above the external thread 13, which, during the screwing-in operation, acts upon the shifting member 218. The same is moved by the screwing-in operation in the screwing-in operation and thus pretensions the pressure spring.

Due to the ratio of the diameters of threads, pressure gas cylinder and gas chamber casing it is possible that a powerful pretension is obtained with but little manual effort. The pretension force presses continuously on the screw coupling of housing and pressure gas bottle so that a detachment due to vibrations and other external influences is prevented.

Figure 7:
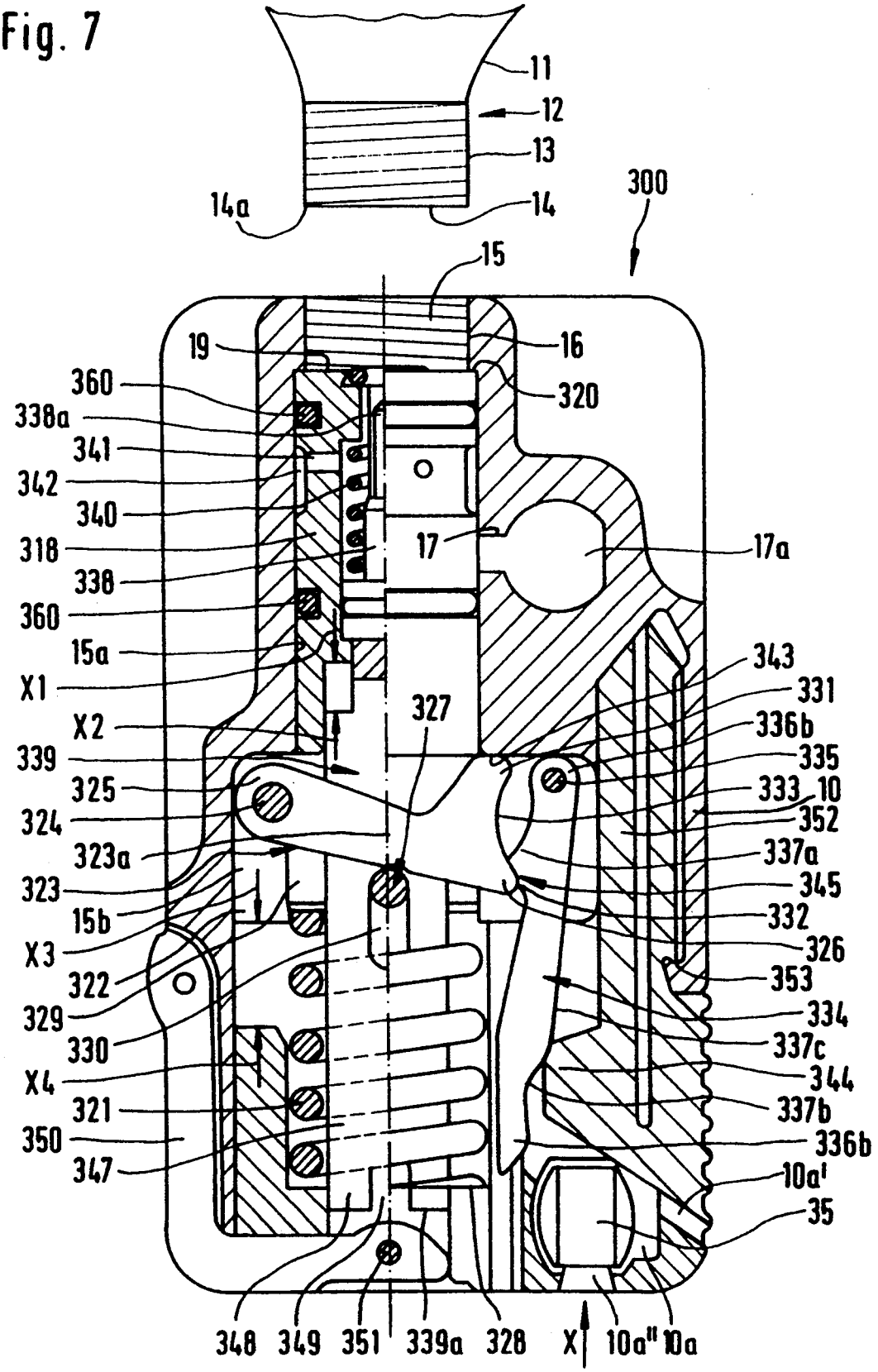
FIG. 7 shows a further embodiment of the device.

In FIG. 7, a further embodiment of the device 300 for inflating a floating body not shown in the drawing of a likewise non-depicted piece of lifesaving equipment with pressure gas is illustrated. The pressure gas container that is insertable into the housing 10 of the device 300 is identified with 11.

The pressure gas container 11 which is constructed in the form of a gas pressure cylinder is, within the area of the container neck 12, provided with an external thread 13 and is sealed by means of a diaphragm 14. In a housing bore 15 which, in its upper section, is provided with an internal thread 16 and which can be made to communicate via a branch duct 17 and an air connection piece disposed at 17*a*, with a non-depicted piece of lifesaving equipment to be inflated, the shifting member 318 is disposed which is constructed in the form of a sleeve and which, with one of its front sides 19, reaches into the area of the upper housing bore 15 with the internal thread 16 and, during the screwing-in operation of the pressure gas container 11, is consequently acted upon by the neck 12 of the latter, it being possible, however, for another structural design and layout to be employed.

The shifting member 318 which is guided so as to be longitudinally displaceable within a pertinent recess 15*a*, is secured against slipping through in the housing 10. A limit stop appropriately provided in the housing is indicated at 320. Furthermore, the shifting member 318 is supported on a tensioning member 322 which is longitudinally guided in a section 15*b* in the housing bore 15.

On the tensioning member 322, a first one-armed lever 323 is hinged on so as to be swivelable on one end in the form of an actuating lever, and this in such a way that said lever 323 is swivelable about the swivel axis indicated at 324. The two ends of the one-armed lever 323 are identified with 325 and 326, respectively. This lever 323 is supported with an upper end 327 on a spring 321, while the spring 321 is supported at the bottom in the housing at 328. The upper terminal area of the spring 321 is guided in an internal cavity 329 of the tightening member 322 and the upper end 327 reaches through an oblong hole 330 extending in the longitudinal direction in a central bolt and is guided in the latter.

On its free end 326, the lever 323 has a first lug-shaped section 331 proceeding in the direction of the pressure gas container 11 which is angled relative to the lever 323 itself; in addition, onto the free end 326 of the lever 323, in extension of the concentric longitudinal axis of the lever, a second lug-shaped section 332 is formed which is provided with a section 333 proceeding obliquely or curvedly in the direction of the lug-shaped section 331 as a limit stop surface for a second one-armed lever 324 that is swivelably hinged onto the housing 10. The free end of the lug-shaped section 331 of the lever 323 is constructed in the form of a curved limit stop area which, in the non-tensioned state of the device 100, rests against a surface 334 of the housing 10, as is depicted in the drawing.

The second one-armed lever 334 in the form of a tripping lever is likewise hinged onto the tensioning member 322 approximately at the level of the lug-shaped section 331 of the lever 323, while the swivel axis is indicated at 335. The two swivel axes 324 and 335 of the two levers 323, 334, in the position of the individual components of the device 300, lie approximately in one plane.

The lever 334 assumes an approximately parallel position relative to the central bolt 339 carrying the opening striker 338. The two ends of the lever 334 are identified with 336*a*, 336*b*. With its free end 336, the lever 334 lies within the area of the automatic element 35. The lever 323 with its limit stop surface 333 of its lug-shaped section 332, rests against the cam-shaped section 337*a* constructed on the longitudinal side wall 337*a* of the lever 334 which faces the lever 323. In addition, the lever 334, within the area of of its free end 336*b*, is provided with a longitudinal recess 337*b* facing the automatic element 35. The lug-shaped sections 331, 332 and 337*a* of the two levers 323, 334 may also be constructed in the form of cams. The lug-shaped sections 337*a* and 332 of the two levers 323, 334 interact in such a way that a kind of blocking or locking is possible, as is shown in the drawing.

The device 300 functions as described below.

When the pressure gas container 11 is screwed into the tripping mechanism, the shifting member 318 and, therefore at the same time the tensioning member 322, are moved downwardly preferably by about 8 mm. The spring 321 is tensioned thereby. The spike 328*a* of the opening striker 338 penetrating the diaphragm 14 is in this case retained by a spring 340 so that the spike 338*a* is unable to inadvertently pierce the pressure gas container 11. Following the tripping, the same spring 340 returns the spike 338*a* into its initial position so that, after the diaphragm 14 has been pierced, the pressurized gas or the compressed air is able to flow out of the pressure gas container 11 and, via the slit 341 and the annular space 342, enters the branch duct 17.

In the non-tensioned state of the device, the upper lug-like section 331 of the lever 323 rests against the housing 10 at 343 so that its force is transferred to the opening striker 338.

In the course of the tensioning, the lower free end 336*b* of the lever 334 is frictionlessly brought close to the automatic element 35 by means of a trapezoidally configured section 344 which is constructed on the housing 10, in which case this trapezoidal section 344 lies in the path of movement or advance of the lever 334. Said trapezoidal section 344 prevents that the lever 334 chafes against the automatic element 35 during the tensioning operation, i.e. friction is prevented. When the automatic element disintegrates, the tripping tolerance within that area within which both levers 323, 334 are in operative connection with their lug-shaped sections 331, 337*a* is preferably 1 mm. This area is indicated in the drawing at 345. Consequently, all abrasion from the automatic element present in tablet form is prevented.

In the shifting member 318 which is constructed in the form of a sleeve, the opening striker 338 is disposed so as to be displaceable relative to the shifting member 318, said opening striker which, in its normal position, reaches with its spike 338*a* into the area of the front side 19 of the sleeve 318 and is mounted on a central bolt 339 with which it may be integral. The central bolt 339 is disposed paraxially to the longitudinal axis L of the housing bore 15 in the same and reaches through the tensioning member 322 wherein it is glidingly guided. In the tensioned state of the device, the central bolt 339 is supported with the aid of a lower surface 339*a* located opposite the opening striker 338 on the free end of the actuating arm 350, it being also possible for the free surface 331*a* to be constructed in the form of a shoulder of the central bolt 339 when the central bolt is made to project with its end from the housing 10 in order to form an indicating means.

During the tensioning operation the opening striker 338 and the central bolt 339 is pressed so far downward that the shank 347 of the central bolt 339 projects with a section 348 from the lower area of the housing 10 so that the marking applied from the outside to this section 348, e.g. in the form of a color coating, is clearly perceptible.

In order to render possible the exit of the shank 347 of the central bolt 339 from the lower area, the end of the shank 347 is provided with a slot-like recess 349 so as to enable the same to glide past the axis 351 of a lever 350.

The force of the spring 321 is transmitted to the central bolt 339 and onto the lever 323 via the oblong hole 330. The lever 323 is prevented from moving upwardly by the lever 334 by means of the interlocking lug-shaped sections 331, 337*a*.

Following the disintegration of the automatic element 35, the free lower end 336*b* of the lever 334 is able to move in the direction of the automatic element 35 disposed inside a chamber, a cavity or a recess 10*a* in the housing 10, in which case the lever 323 is simultaneously released, moved upwardly and, at the same time, allows the spring-loaded central bolt 339 to be impelled in the upward direction. The central bolt 339 urges the spike 338*a* of its opening striker about 4 mm (compression path) in the upward direction, whereby an area of approximately 2½ mm pierces the diaphragm 14 of the pressure gas container 11 so that the point 338*a* of the opening striker 338 penetrates the sealing diaphragm 14 of the pressure gas container 11 and opens the same so that the gas from the pressure gas container 11 is able to enter the housing bore 15 and, through the slit 341 and the annular space 342 in the shifting member 318, into the branch duct 17, said duct communicates with a non-depicted floating body in a manner known per se. In this case the shifting member 318 is provided with appropriate sealing rings 360 resting against the wall of the housing bore 15 in order to prevent an inadvertent escape of the pressure gas from the device or into spaces or chambers thereof.

The oblong hole shown in the drawing at 330 within the area of the spring end 327 is necessary for a manual tripping operation since otherwise it will not be possible to displace the central bolt 339.

The chamber 10*a* for the automatic element 35 may be constructed in the housing 10 of the device 300. In this case, care has to be taken that, via a closable filling aperture of the chamber 10*a*, access is available for the insertion of the automatic element 35. The chamber 10*a* is provided with a pressure balance venting opening 10*a*′ and with a further opening 10*a*″, through which water is able to penetrate in the direction of arrow X into the chamber in order to enable it to act upon the automatic element 35.

In the embodiment example illustrated in the drawing, the chamber 10 for the automatic element 35 is disposed in a drawer-like-constructed part 352 which e.g. is retained by means of a force fit in a recess constructed in the housing 10. This part 352, on the side with which it faces the lever 334, carries the trapezoidal section 344 and can be click-locked inside the housing at 353.

By means of the arrows X1, X2, the compression path is indicated in the drawing which is approximately 4 mm. The section indicated by the arrows X3, X4 is the tensioning path which is approximately 8 mm.

Figure 8:
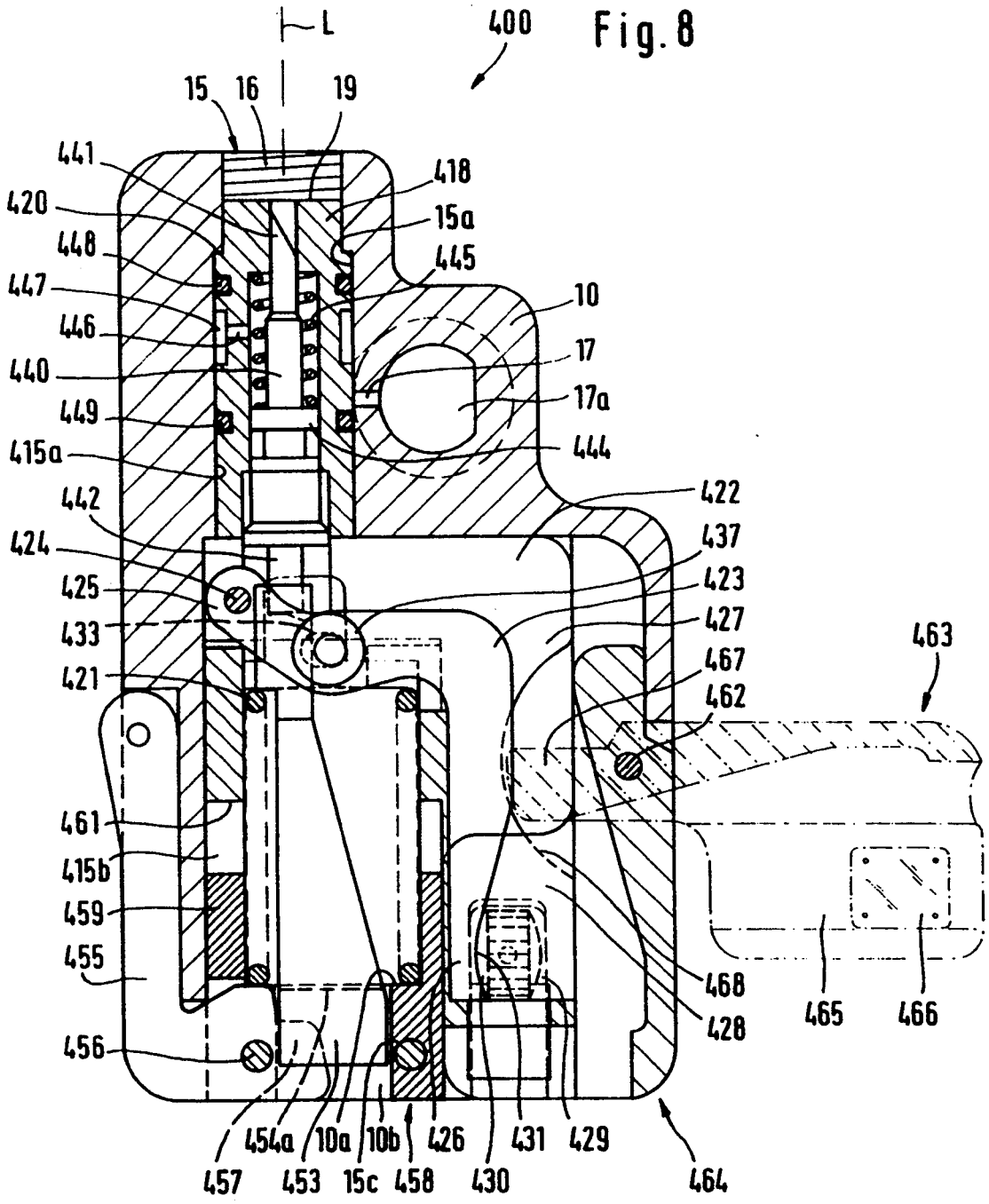
FIGS. 8 through 10 show a further embodiment of the device in three operational stages.
Figure 9:
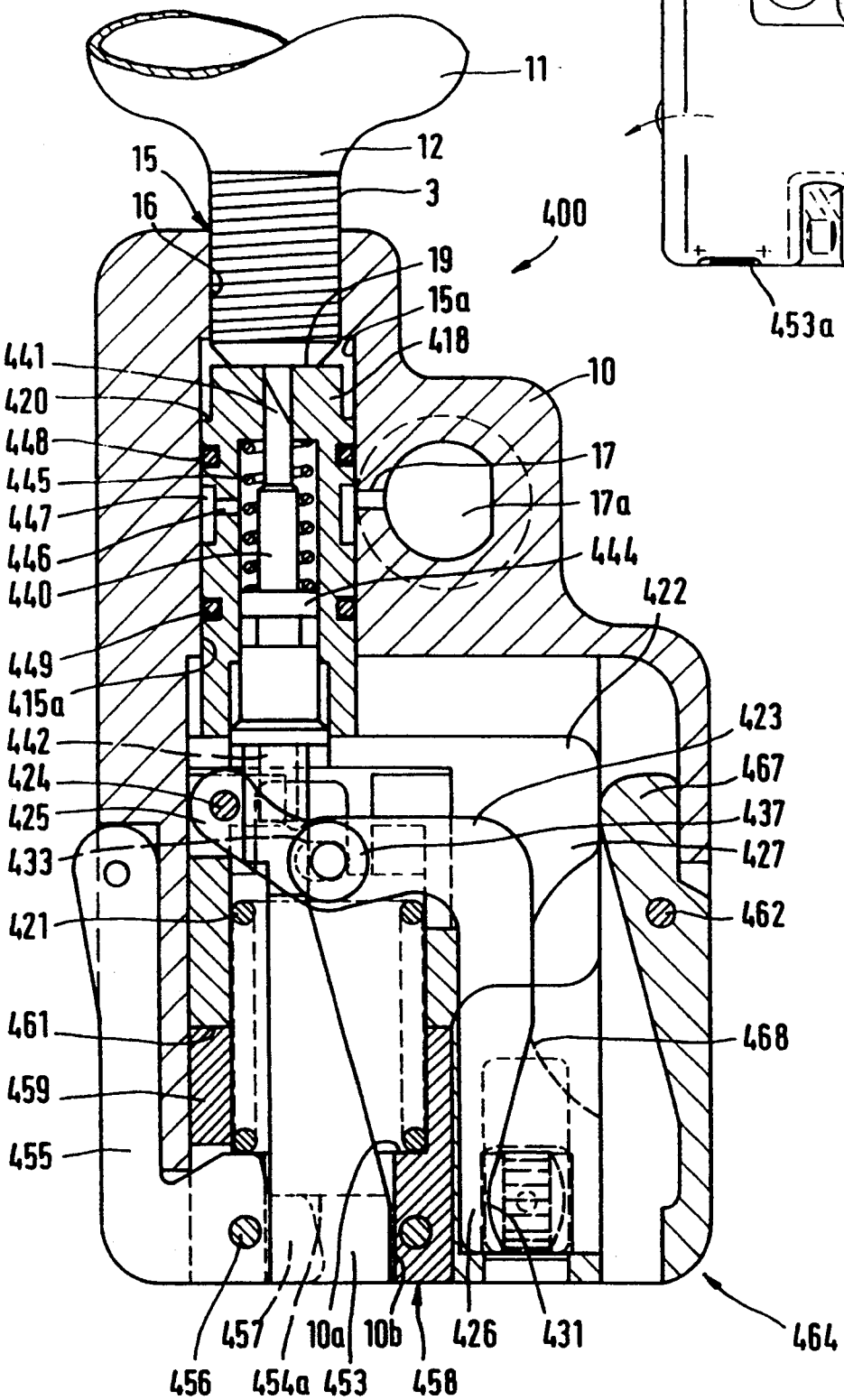
Figure 10:
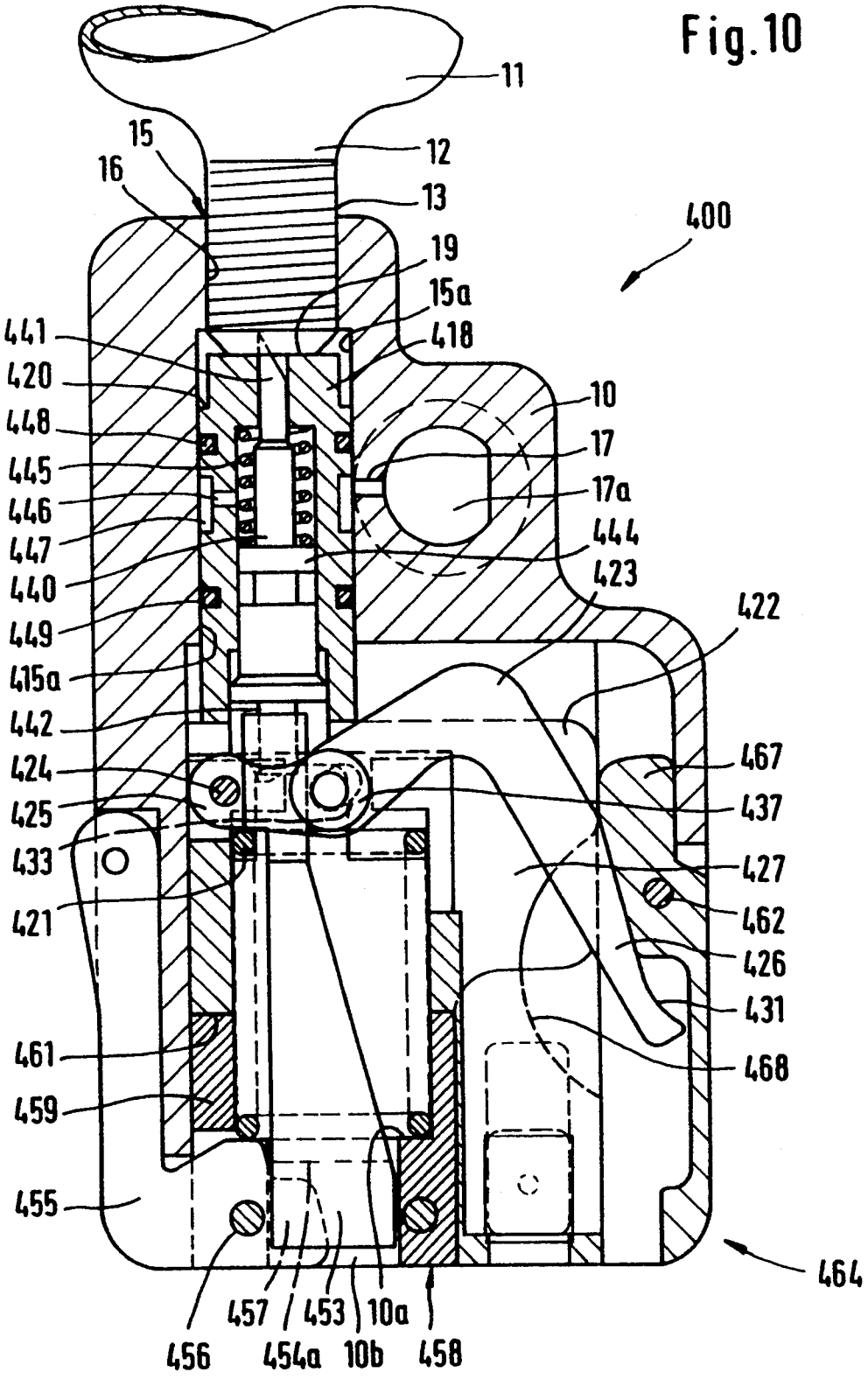

In the FIGS. 8 through 10, a further embodiment of the device 400 for inflating a floating body not shown in the drawing of a likewise non-depicted piece of lifesaving equipment with pressure gas is illustrated. The FIGS. 11 through 15 show the relevant most essential individual components. The pressure gas container to be inserted into the housing 10 of the device 400 is identified with 11.

The pressure gas container 11 which is constructed in the form of a pressure gas cylinder, is, within the area of the container neck 12, provided with an external thread 13 and sealed by means of a diaphragm 14. In a housing bore 15 which, on its upper part, is provided with an internal thread 16 and which, via a branch duct 17, an air connection piece disposed at 17*a*, can be made to communicate with a non-depicted piece of lifesaving equipment to be inflated, the shifting member 418 is disposed which is constructed in the form of a sleeve and which reaches with one of its front sides 19 into the area of the upper section of the housing bore 15 with the internal thread 16 and, when the pressure gas container 11 is screwed in, is consequently acted upon by the container neck 12, it being also possible, however, for another structural design and layout to be employed.

The shifting member 418 which is guided so as to be longitudinally displaceable in the housing 10 in an appropriate recess 15*a*, is secured against a slipping through in the housing 10. A limit stop pertinently provided in the housing is indicated at 420. The spring, whose disposition will yet be explained hereinafter, is identified with 421. In addition, the shifting member 418 is supported on a tensioning member 422 that is guided longitudinally displaceable in a section 415*b* in the housing bore 15, with which it may be rigidly connected or be integral.

A first one-armed lever 423 in the form of an actuating lever is hinged onto the tensioning member 422 so as to be swivelable with one end, and this in such a way that said lever 423 is swivelable about the swivel axis indicated at 424. The two ends of the one-armed lever 423 are identified with 425 and 426. At its free end 426, the lever 423 lies within the area of the automatic element 35. The tensioning member 322 possesses a downwardly angled, eccentric arm-like tongue member 427 which, within the area of its free end 428, possesses the accommodation chamber 429 for the automatic element 35, said chamber may be constructed in the form of a chamber, cavity, recess or the like. In this case the accommodation chamber is provided with a lateral opening 430 so that a bearing section 431 of the free end 426 of the lever 425 is able to rest against the automatic element 35. The accommodation chamber 429 is displaceable by means of the tensioning member 422 which is displaceable in section 15*b*. Within this displacement area of the accommodation chamber 429, the housing 10 is provided with a window-like cutout 432 (FIG. 8*a*).

Within the vicinity of its upper end, but at a distance from the axis of rotation 424, the lever 423 possesses a perforation 433 through which the lifting axis 434 is passed with the shank 434*a*, on both ends of which the supporting members 437, 438, which are annular or in the form of a cylindrical member, are disposed, which are supported on the pressure spring 421. The perforation 433 is constructed in a slot-like fashion so as to render a movement of the lever 423 with the lifting axis possible.

In the tensioning member 422, the central bolt 439 is disposed so as to be glidingly guided in the latter and to be displaceable relative to the same. The central bolt 439 is disposed coaxially to the longitudinal axis L of the housing bore 15 in the same and it reaches through the tensioning member 422. The opening striker 440 which carries the spike 441 for piercing the diaphragm 14 is, with its actuating striker 442, which is disposed so as to be located opposite the spike 441, inserted into a receiving aperture 443 of the central bolt 439 and is supported by the latter. The opening striker 440 is provided with an annular flange upon which a spring 445 is supported.

The spike 441 of the opening striker 440 which punctures the diaphragm 14 is in this case retained by a spring 445 so that the spike 441 is unable to inadvertently penetrate into the pressure gas container 11.

The same spring 445 returns the spike 441 into its initial position subsequent to the tripping so that, following the piercing of the diaphragm 14, the pressurized gas or compressed air is able to flow from the pressure gas container 11 and, via the slit 446 and the annular space 447, into the branch duct 17. On the opening striker 440, above and below the annular space 447, sealing rings 448, 449 are disposed for sealing purposes.

The central bolt 439, within the area of the receiving aperture 443, possesses two laterally projecting bearing arms 450, 451, against which the spring 421 comes to bear when the device 400 is triggered and displaces the central bolt 439 upwardly. The central bolt 439 possesses a downwardly widening section 452 which passes into a guide member 453 which is guided within a lower section 15*c* of the housing bore 15. In the guide member 453, a slot-like recess 454 is constructed. The same serves, on the one hand, to allow the central bolt to be able to glide past a cam-like projection 457 of a one-armed hand lever 455 that is swivelable about a housing-integral axis 456. During the tensioning, the opening striker 440 and the central bolt 439 are pressed down to such an extent that the central bolt 439 projects with a section 453*a* from the lower area of the housing 10 so that, from the outside, a marking applied to this section 453*a* e.g. in the form of a color coating, is clearly perceptible. On the other hand, the bottom 454*a* of the recess 454 forms the bearing surface for the projection 457 when the hand lever 455 for manual tripping is swiveled outwardly counterclockwise and, with the aid of the projection 457, raises the central bolt 439 so as to cause the opening striker 440 with the spike 441 to pierce the diaphragm 14.

Provision is made for assembly-related reasons for the section 15*c* of the housing bore 15 to be closed by a clamping member 458 attached by means of a screwed connection or the like which possesses the bearing surface 10*a* for the spring and an aperture 10*b* for the issue of the section 453*a*. Also the axis 456 is disposed on the same. The clamping member 458 has an annular member 459 bearing against the housing wall of the section 415*b* as limit stop for the tensioning member 422 in order to render a pretensioning of the spring 421 possible. For this purpose, in the tensioning member 422, an oblong hole 460 extending parallel to the longitudinal axis L and open at the bottom on one end, which engages over the lifting axis 434 has been constructed. In the course of a downward motion of the tensioning member 422 due to the screwing in of the pressure gas container 11, the tensioning member 422 compresses the spring 421 via the oblong hole and the lifting axis 434, which spring rests against the housing limit stop 10*d* until the tensioning member impinges with the limit stop surface 461 upon the annular member 459. The distance between the limit stop surface 461 and the annular member 459 depicted in the FIG. 8 corresponds to the displacement path of the tensioning member 422.

A covering member 463 is disposed outside the motion area of the tensioning member 422 so as to be rotatable about a housing-integral axis 462. On this covering member 463 which can be swiveled out of the housing 10 about the axis 462 through an opening 462, a covering plate 465 is attached or is integral with the covering member 463, which, in a non-swung-out position, is disposed in such a way that the covering member 463 covers the displacement area of the accommodation chamber 429 so that, when viewing through the cutout 432, the cove-ring plate 465 can be seen. The same possesses a viewing area 466 which is dimensioned and disposed in such a way that an automatic element 35 inserted into the accommodation chamber 429, is visible only in the tensioned state of the device 400, i.e. only when the tensioning member 422 is in its lower position.

The viewing area 466 may be constructed in the form of a window, provision may also be made for the material, by preference plastic, to be dimensioned to be so thin at this point that a viewing possibility is provided.

In addition, the covering member 463 has a lug-like, spike-like or cam-shaped blocking arm 467. The same is swivelable with the covering member 463, however, its swivel path is only unblocked when the device 400 is not in the tensioned state. To this end a blocking arm receiving recess 468 is constructed on the tongue member 427 above the accommodation chamber 429, in which the blocking arm can be swiveled freely.

In essential points the functioning of the device 400 corresponds to that of the devices explained in the foregoing and is as will be detailed in the following.

To begin with, the covering member 463 is swiveled into the position shown in a broken line in FIG. 8 so that the covering plate 465 exposes the accommodation chamber 429. A tablet in the form of a new automatic element is inserted into the latter. The accommodation chamber 429 is now closed in that the covering member 463 is swiveled into the position depicted in FIG. 8, in which the covering plate 465 covers the accommodation chamber 429. In this case the viewing area 466 merely unblocks the view within an area into which the automatic element is displaced only when the device is tensioned.

The swiveling of the covering member is only possible in this position of the tensioning member 422 as shown in FIG. 8, i.e. in which the device 400 is still non-tensioned and the tensioning member 422 is in its upper position limited by the end of the section **15*b* and the blocking arm receiving recess 468 is located exactly opposite the blocking arm 467 of the covering member 463** so that an unimpeded swivelability of the covering member is possible.

Figure 11:
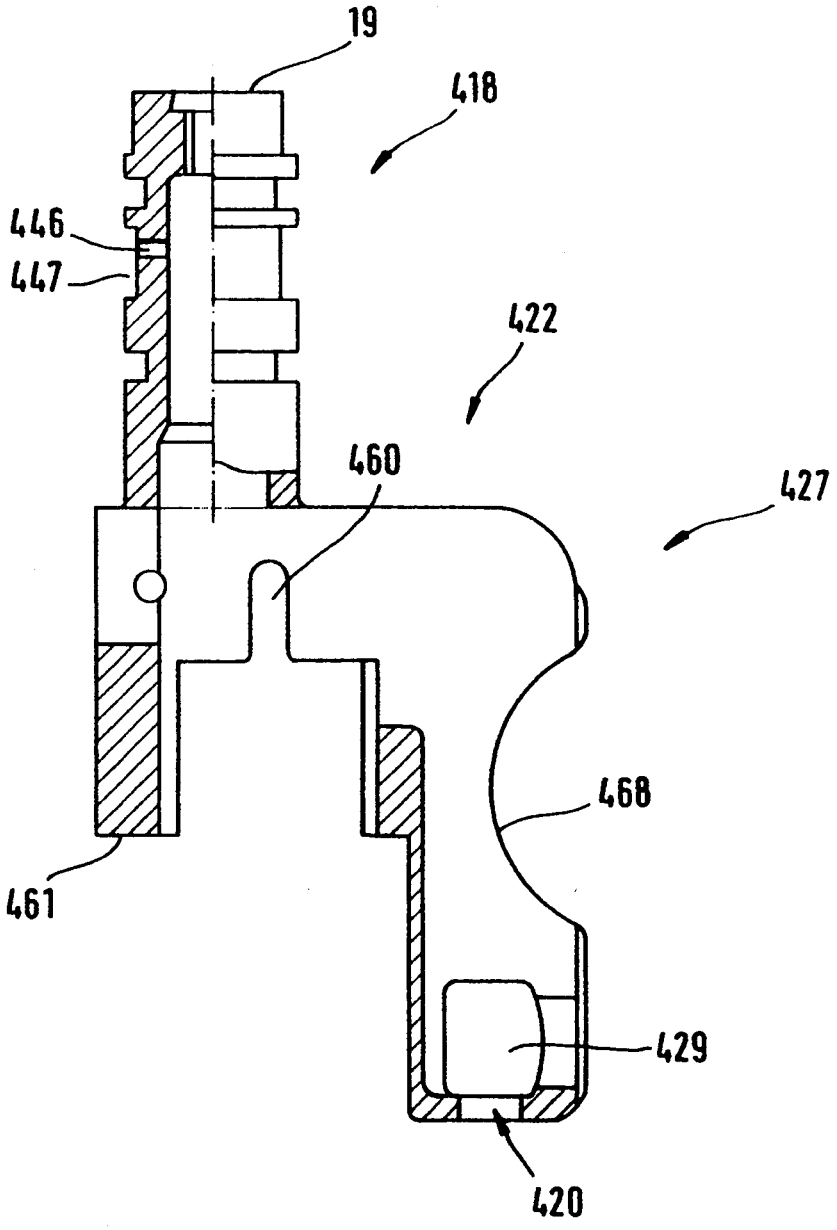
FIGS. 11 through 15 show, in side elevations, individual elements of the device according to FIGS. 8 through 10.
Figure 12:
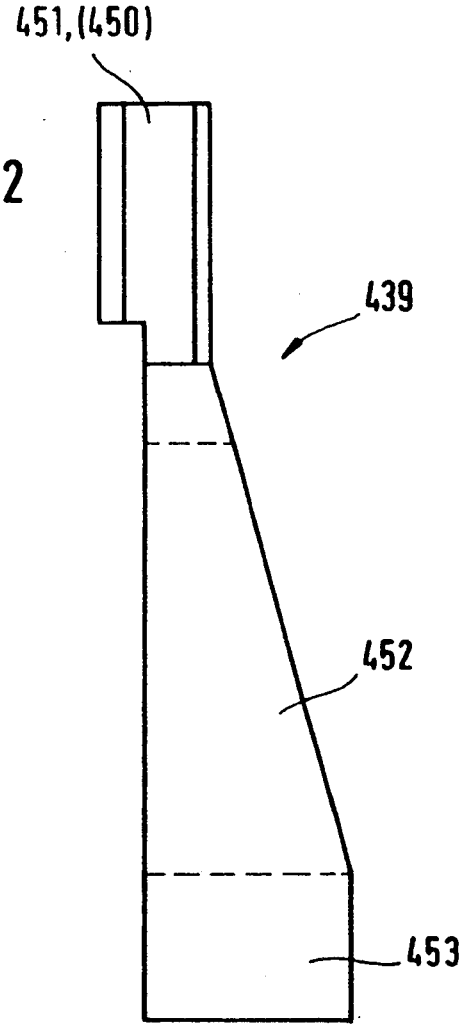
Figure 13:
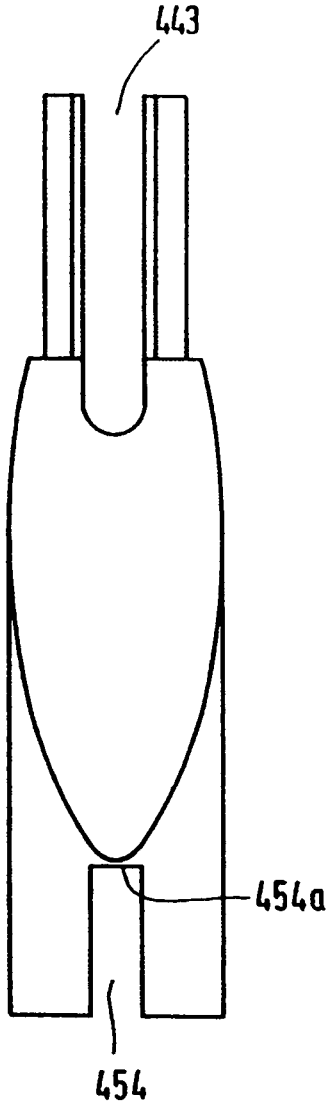
Figure 14:
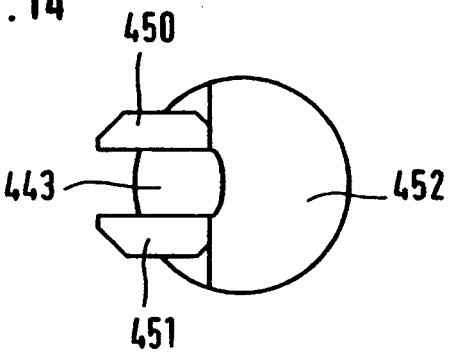
Figure 15:
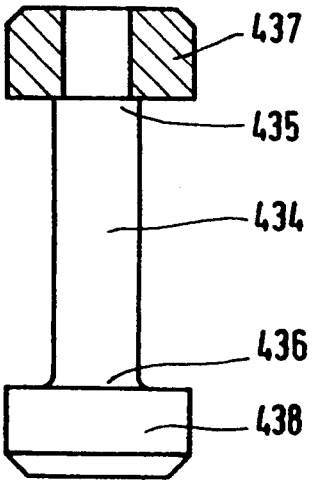

When the pressure gas container 11 is screwed into the tripping mechanism, the shifting member 418 and, consequently, the tensioning member, is moved in the downward direction. The tensioning member 422 takes the lifting axis 434 along in the downward direction across the terminal area of the oblong hole 460 (FIG. 11). The same is moved along downwardly by means of its supporting members 437, 438 which rest upon the pressure spring 421 constructed in the form of a helical spring so that the spring 421 is compressed and tensioned. In the process, the spike 441 provided for the penetration of the diaphragm 14 is pressed downwardly by the spring 445 so that the spike 441 of the opening striker 440 is unable to inadvertently puncture the diaphragm 14 of the pressure gas container 11.

Figure 9A:
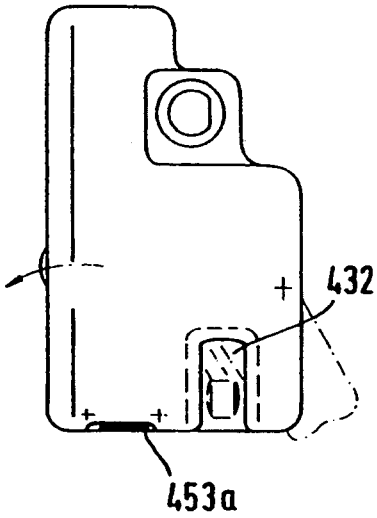

In the process, also the central bolt 439 is moved downwardly so that also the guide member 453 guided in the housing aperture **10*b* is moved in the downward direction and the section 453*a* in the window-like cutout at the aperture 10*b* indicated in FIG. 9*a*** becomes visible.

Due to the displaceable disposition of the accommodation chamber 429, the bearing section 431 on the end 426 of the lever 423 does already bear against the automatic element 35 also when in the non-tensioned state. That is why, during the tensioning, the lever 423 and the automatic element are jointly and simultaneously displaced downwardly so that no friction takes place here. Consequently, all abrasion of the automatic element 35 which assumes the form of a tablet, is prevented.

The screwing in of the pressure gas container 11 is effected for so long until the limit stop surface 461 impinges upon the annular member 459 which forms a housing edge as it were and a further insertion of the pressure gas container and thus a further tensioning is no longer possible. The device is then in the pretensioned position as depicted in FIG. 9. In this position, the blocking arm receiving recess 468 is preferably displaced out of the swiveling range of the blocking arm 467 so that the blocking arm bears firmly against a stop limit edge on the tensioning member 422 and, consequently, a swiveling of the covering member 463 toward the opening of the device is no longer possible. The accommodation chamber 429 is now located below the viewing area 466 of the covering plate 465 so that it is possible to see the automatic element 35 from the outside through the window-like cutout 432 of the housing 410 and the viewing area 466, whereby it can be ascertained whether and that an automatic element has been correctly inserted into the device 400. At the same time the section **453*a*** indicates that a correct tensioning of the device exists.

In this connection it is provided that the lever arm 423, while subject to the action of a spring 412, swivels outwardly in the non-tensioned state of the device if the covering member 463 is closed without that an automatic element 35 had been inserted. In this case provision is then made for the lever 423 to block the screwing-in operation so that the pressure gas container 11 cannot be screwed in.

Therefore, an operating error is impossible.

After the automatic element 35 has disintegrated, the free lower end 428 of the lever 423 is able to move into the position illustrated in FIG. 10, whereby the lifting axis 434 is then moved upwardly and the supporting members 437, 438 release the spring 421. These then impinge upon the bearing arms 450, 451 of the central bolt 439 and impel the same in the upward direction. The central bolt 439 then moves the opening striker 440 along in the upward direction so that the spike 441 penetrates into the diaphragm 14 of the pressure gas container 11, thus allowing the gas to flow out from the pressure gas container 11 and into the housing bore 15 and through the slot 446, into the annular space 447.

From here the pressure gas then flows into the branch duct 17 which, at **17*a*, communicates in a manner known per se with a floating body not shown in the drawing. In this case the shifting member 418 is provided with appropriate sealing rings 448, 449 which bear against the wall of the housing bore 15***a* so as to prevent an inadvertent escape of the pressure gas from the device or into other spaces or chambers of the same.

In order to now bring the device 400 into an operative state it is necessary first of all that the pressure gas container 11 be unscrewed. Thereupon it is possible to swivel the covering member 463 into the position shown in FIG. 8, whereby, with the aid of the blocking arm 467, the lever 423 is simultaneously acted upon and the same, from its swiveled-out position shown in FIG. 10, is swiveled into the position shown in FIG. 8, in which it is possible to dispose an automatic element 35 in the accommodation chamber 429 which then rests against the bearing section 431 rightaway.

When the device is in its pretensioned state as per FIG. 9, then it is possible, by pulling on the hand lever 455 in the direction indicated in FIG. 9*a* by the arrow, to trip the device since the projection 457 then engages into the recess 454 of the guide section 453 and, while knocking on its bottom 454*a*, moves the central bolt 239 upwardly and thus causes the spike 441 to pierce the diaphragm 14. The operating sequence which then follows corresponds to that of the automatic tripping.

The device is altogether constructed in such a way that operating errors are impossible. Moreover, a checking of the state of the tension is also possible at all times. It is also possible to easily realize the individual functions by means of somewhat differently constructed components. It is possible, for example, to construct the covering member not in the form of a swivel member, but as a cylindrical turned part which is likewise provided with a pertinent blocking arm and a covering range.

In all the embodiments a metallic helical spring has been provided as spring element, in which connection, by spring element, the element to be designated as main spring element for the displacement of the opening striker into the diaphragm has to be understood. It is possible, however, in lieu of the metallic spring, to employ a different type of spring element which likewise accommodates the potential for tripping the device. On this occasion a pneumatic reservoir is just as conceivable as a hydraulic one, for it merely matters that the potential for the tripping, i.e. for piercing the diaphragm, can be durably stored.

The central bolt is constructed in the form of a central indicator and indicates that the cartridge is screwed-in to a correct depth, i.e. up to the stop and that the automatic mechanism is tensioned, i.e. that the overall function is given. The indication disappears after the tripping, be it automatic or manual. In addition, the construction is such that the pressure cartridge has to be unscrewed in order to open the accommodation means for the tablet.

What is claimed is:

1. A device (100;110;200;300;400) for inflating a container or a floating body of a piece of lifesaving equipment with a pressure gas from a pressure gas container (11) sealed with a diaphragm (14) which, within the area of a container neck (12), has an external thread (13) and which, with the container neck (12), can be screwed into a receiving aperture (15) in a housing (10) that is provided with a corresponding internal thread (16), and whose content of gas is released by the diaphragm (14) being opened by an opening striker (24) disposed inside the housing (10), which may be moved by means of a hand lever and by the force of a spring element against the diaphragm (14), in which the spring element is retained in a pretensioned position with the aid of an automatic element (22;35) which loses its solidity in water, characterized in that:

the pressure gas container (11) can be screwed into the receiving aperture (15) of the housing (10) while simultaneously pretensioning the spring element;

a spring (30;121;321;421) in the form of a spring element can be tensioned by means of a shifting member (18;118;318;418) displaceably guided in the housing (10) and acting upon the spring (30;121;321;421), and in that the shifting member (18;118;318;418), during the screwing-in of the pressure gas container (11), can be displaced from an initial position in the pretensioning direction of the spring (30;121;321;421) by the pressure gas container (11); and the spring (121) is disposed between the shifting member (118) and a first surface (124) of a tensioning member (122) which is guided so as to be longitudinally displaceable in the housing (10) in the longitudinal direction (L) of the housing bore (15), and in that a second surface (125) of the tensioning member (122) that is located opposite the first surface (124), is supported on a two-armed lever (130) which is swivelable about a housing-integral axis (129).

2. A device according to claim 1, characterized in that during the screwing-in and tensioning operation, the shifting member (18;118;318;418) can, with the aid of a front side (19) of the pressure gas container (11), be acted upon by means of a front end (14*a*) surrounding the diaphragm (14) of the pressure gas container (11) and is displaceable by at least a part of the screwing-in path of the pressure gas container (11) in the screwing-in direction (E).

3. A device according to claim 1, characterized in that during a screwing-in and tensioning operation, the shifting member (18;118;318;418) can be acted upon by a surface area of the pressure gas container (11) and is displaceable by at least a part of the screwing-in path of the pressure gas container (11) in the screwing-in direction (E).

4. A device according to claim 3, characterized in that the shifting member (18), in its end (20) located opposite the front side (19), is provided with a pocket-like accommodation housing (21) for the automatic element (22).

5. A device according to claim 4, characterized in that the pocket-like accommodation housing (21) possesses an opening (26) for supporting a central bolt (25) on the automatic element (22), in which the central bolt (25), when released by the automatic element (22), while subject to the action of the spring (30), brings about the opening of the diaphragm (14) of the pressure gas container (11) with an impact end (28).

6. A device according to claim 5, characterized in that the opening striker (24) and the central bolt (25) are guided so as to be longitudinally displaceable inside the shifting member (18).

7. A device according to claim 5, characterized in that the spring (30) is supported at both ends on the housing (10).

8. A device according to claim 1, characterized in that the two-armed lever (130) possesses a tripping arm (131) and an actuating arm (132), while a free end (133) of the tripping arm (131) is disposed so as to reach into the area of a pocket-like accommodation chamber (134) for the automatic element (35) and, with a free end (137) of the actuating arm (132), a central bolt (139) disposed in the housing bore (15) and carrying the opening striker (138) can be acted upon, and that the second surface (125) of the tensioning member (122), with the aid of a tensioning lever (127) which can be swiveled about a housing-integral axis (128), is supported on the two-armed lever (130).

9. A device according to claim 8, characterized in that the pocket-like accommodation chamber (134) has an opening (134*a*) for supporting the tripping arm (131) on the automatic element (135), while the tripping arm (131), with the aid of the actuating arm (132), when released by the automatic element (135) and while subject to the action of the spring (121), brings about the opening of the diaphragm (14) of the pressure gas container (11) by acting upon the central bolt (139).

10. A device according to claim 1, characterized in that the receiving aperture (15) of the housing (10) is constructed inside the shifting member (218) and that, during a screwing-in and tensioning operation, a housing surface (15*b*) can be acted upon by the pressure gas container by means of the front-end rim (14*a*) of the pressure gas container (11) surrounding the diaphragm (14), and in that the shifting member projects from the housing by at least a part of the screwing path of the pressure gas container (11) opposed to the screwing-in direction (E).

11. A device according to claim 10, characterized in that the spring (221) is disposed between a radial surface of the shifting member (218) and a first radial surface (224) of a tensioning member (222) which is guided so as to be longitudinally displaceable inside the housing (10) in the longitudinal direction (L) of the housing bore (15), and in that a second radial surface (225) of the tensioning member (222) located oppositely to the first radial surface (224) is supported on a two-armed lever (230) which can be swiveled about a housing-integral axis (229).

12. A device (100;110;200;300;400) for inflating a container or a floating body of a piece of lifesaving equipment with a pressure gas from a pressure gas container (11) sealed with a diaphragm (14) which, within the area of a container neck (12), has an external thread (13) and which, with the container neck (12), can be screwed into a receiving aperture (15) in a housing (10) that is provided with a corresponding internal thread (16), and whose content of gas is released by the diaphragm (14) being opened by an opening striker (24) disposed inside the housing (10), which may be moved by means of a hand lever and by the force of a spring element against the diaphragm (14), in which the spring element is retained in a pretensioned position with the aid of an automatic element (22;35) which loses its solidity in water, characterized in that:

the pressure gas container (11) can be screwed into the receiving aperture (15) of the housing (10) while simultaneously pretensioning the spring element;

the receiving aperture (15) of the housing (10) is constructed inside the shifting member (218) and that, during a screwing-in and tensioning operation, a housing surface (15*b*) can be acted upon by the pressure gas container by means of the front-end rim (14*a*) of the pressure gas container (11) surrounding the diaphragm (14), and in that the shifting member projects from the housing by at least a part of the screwing path of the pressure gas container (11) opposed to the screwing-in direction (E); and a spring (221) is disposed between a radial surface of the shifting member (218) and a first radial surface (224) of a tensioning member (222) guided in the housing (10) in the longitudinal direction (L) so as to be longitudinally displaceable, and in that a second radial surface (225) of the tensioning member (222) located opposite the first radial surface (224), is supported upon a two-armed lever (230) which is swivelable about a housing-integral axis (229).

13. A device according to either claim 11 or 12, characterized in that the two-armed lever (230) possesses a tripping arm (231) and an actuating arm (232), while a free end (233) of the tripping arm (231) is disposed so as to reach into the area of a pocket-like accommodation chamber (234) for the automatic element (35) and a second radial surface of the tensioning member can be acted upon by a free end (237) of the actuating arm (232), while the tensioning member possesses a third radial surface which is located opposite the first radial surface, by means of which the central bolt (239) disposed in the housing bore (15) and carrying the opening striker (238) can be acted upon.

14. A device according to claim 13, characterized in that the pocket-like accommodation chamber (234) posseses an opening (234*a*) for supporting the tripping arm (231) on the automatic element (35), while the tripping arm (231), by means of the actuating arm (232), when released by the automatic element (35), while subject to the action of the spring (231) and while acting upon the tensioning member (222), acts upon the central bolt (239) with its third radial surface (224*a*), thus bringing about the opening of the diaphragm (14) of the pressure gas container (11).

15. A device (100;110;200;300;400) for inflating a container or a floating body of a piece of lifesaving equipment with a pressure gas from a pressure gas container (11) sealed with a diaphragm (14) which, within the area of a container neck (12), has an external thread (13) and which, with the container neck (12), can be screwed into a receiving aperture (15) in a housing (10) that is provided with a corresponding internal thread (16), and whose content of gas is released by the diaphragm (14) being opened by an opening striker (24) disposed inside the housing (10), which may be moved by means of a hand lever and by the force of a spring element against the diaphragm (14), in which the spring element is retained in a pretensioned position with the aid of an automatic element (22;35) which loses its solidity in water, characterized in that:

the pressure gas container (11) can be screwed into the receiving aperture (15) of the housing (10) while simultaneously pretensioning the spring element;

a spring (30;121;321;421) in the form of a spring element can be tensioned by means of a shifting member (18;118;318;418) displaceably guided in the housing (10) and acting upon the spring (30;121;321;421), and in that the shifting member (18;118;318;418), during the screwing-in of the pressure gas container (11), can be displaced from an initial position in the pretensioning direction of the spring (30;121;321;421) by the pressure gas container (11); and the shifting member (318) is supported on a tensioning member (322) guided so as to be displaceable within a section (15*b*) of the housing bore (15), in that, on the tensioning member (322), a first one-armed lever (323) is hinged onto the tensioning member (322) so as to be swivelable at one end, which can be acted upon by an end piece (327) of the spring (321) provided on the shank (347) of a central bolt (339) carrying the opening striker (338) and which, on its free end, possesses a lug-shaped section (331) proceeding in the direction of the pressure gas container (11) and angled relative to the longitudinal lever axis (323*a*), as well as a second lug-shaped section (332) proceeding in extension of the concentric longitudinal lever axis (323*a*) having a section (333) which proceeds obliquely or curvedly in the direction of the first lug-shaped section (331) in the form of a limit stop surface for a second one-armed lever (334) hinged swivelably to the shifting member (318), in which case the free end of the first lug-shaped section (331) of the first lever (323) is constructed in the form of a curved limit stop surface which, in the non-tensioned state of the device, rests against a surface (343) of the housing (10), in that the second one-armed lever (334) is hinged onto the shifting member (318) at approximately the level of the hinging point of the first lug-shaped section (331) of the first lever (315), which assumes an approximately parallel position relative to a central bolt (339) with a shank (347) that carries an opening striker (338) and, with its free end, is located within the area of the automatic element (35), while the first lever (323), with its limit stop surface of its second lug-shaped section (332) rests against the longitudinal side wall of the second lever (334) facing the first lever (323) with a longitudinal recess (337*b*) facing the automatic element (35) with the aid of the lug-shaped section in such a way that, when the pressure gas container (11) is screwed in while the spring (111) is simultaneously tensioned, the tensioning member (322) is moved a distance in the direction of the automatic element (35) and is made to pass out of the lower area of the housing (10) thus rendering visible a shank section (348) provided with a marking, and in that, when the automatic element (35) disintegrates, the free end of the second lever (334) is swiveled in the direction of the chamber (10*d*) which accommodates the automatic element (35) of the housing (10) while simultaneously releasing the first lever (323), while the opening striker (338), with its spike-like-constructed top end (338*a*), is moved into the pressure gas container (11) in order to release the pressure gas.

16. A device according to claim 15, characterized in that the housing (10), on its wall facing the lever (334), is provided with a trapezoidally constructed section (344).

17. A device according to any of claim 15 or 16, characterized in that the accommodation chamber (10*a*) for the automatic element (35) is disposed in a drawer-like-constructed part (352), which, by means of detachable connecting means, is retained inside a chamber constructed in the housing, in which case a glide-in part (352), on its wall facing the lever (334), carries a trapezoidally constructed section (344).

18. A device (100;110;200;300;400) for inflating a container or a floating body of a piece of lifesaving equipment with a pressure gas from a pressure gas container (11) sealed with a diaphragm (14) which, within the area of a container neck (12), has an external thread (13) and which, with the container neck (12), can be screwed into a receiving aperture (15) in a housing (10) that is provided with a corresponding internal thread (16), and whose content of gas is released by the diaphragm (14) being opened by an opening striker (24) disposed inside the housing (10), which may be moved by means of a hand lever and by the force of a spring element against the diaphragm (14), in which the spring element is retained in a pretensioned position with the aid of an automatic element (22;35) which loses its solidity in water, characterized in that:

the pressure gas container (11) can be screwed into the receiving aperture (15) of the housing (10) while simultaneously pretensioning the spring element;

a spring (30;121;321;421) in the form of a spring element can be tensioned by means of a shifting member (18;118;318;418) displaceably guided in the housing (10) and acting upon the spring (30;121;321;421), and in that the shifting member (18;118;318;418), during the screwing-in of the pressure gas container (11), can be displaced from an initial position in the pretensioning direction of the spring (30;121;321;421) by the pressure gas container (11); and the shifting member (418) is supported on a tensioning member (422) displaceably guided in a section (415*b*) of the housing bore (15), in that, on the tensioning member (422), a first lever (423) is hinged so as to be swivelable at one end, which, at its other free end (428), possesses a bearing section (431) for the automatic element (35), and which, at its two ends (425, 426), in each case spaced apart, is provided with a perforation (433) reached through by a lifting axis (434), in which the lifting axis (434) is comprised of a cylindrical shank (434*a*) disposed in the perforation with supporting members (437; 438) disposed on both ends, and in that the spring (421), in a non-triggered state of the device (400), is disposed between the supporting members (437; 438) and a bearing surface (10*d*) of the housing (10).

19. A device according to claim 18, characterized in that, within the section (15*b*) of the housing bore (15), a central bolt (439) carrying the opening striker (440) is disposed which possesses at least one bearing arm (450, 451) which projects at right angles to the direction of movement (L) of the opening striker (440) and which, in the event of the device (400) being tripped, can be acted upon by the spring (421).

20. A device according to claim 19, characterized in that the tensioning member (422) possesses an angled, arm-like tongue member (427), in which a chamber (429) for accommodating the automatic element (35) is constructed which possesses an entry opening (430) for the bearing section (431) of the one-armed lever (423), in which the lever (423), in the form of a tripping arm, when released by the automatic element (35), releases the spring by means of the lifting axis and the spring, and, by acting upon the central bolt (439), permits the opening of the diaphragm (14) of the pressure gas container (11) to take place.

21. A device according to claim 20, characterized in that a covering member (413) disposed so as to be swivelable about a housing-integral axis (462), has a covering plate (465) which, in a normal position, covers the accommodation chamber (429) for the automatic element (35) and is swivelable into a swung-out position so as to unblock the accommodation chamber (429) for the insertion of the automatic element (35).

22. A device according to claim 21, characterized in that the covering member (465) has a blocking arm (467) which, in a tensioned normal position of the device (400), with the pressure gas container (11) not screwed in, can be swiveled into a blocking arm receiving recess (468) in the tongue member (427).

23. A device according to either claim 21 or 22, characterized in that the covering plate (465) is provided with a viewing area (466) which, in the tensioned state of the device, is located within the area of the automatic element (35).

24. A device according to claim 23, characterized in that the housing (10) has a window-like cutout (452) within the area of the accommodation chamber (429) for the automatic element (35) and for viewing or checking through the viewing area (466) of the covering plate (465).

25. A device according to any of claims 1, 12, 15 or 18, characterized in that the shifting member (18;118;218;318;418) is constructed in the form of a sleeve.

26. A device according to any of claims 1, 12, 15 or 18, characterized in that the opening striker (138;238;338) together with a central bolt (139;239;339), is guided in the tensioning member (122;222;322) in a longitudinally displaceable manner.

27. A device according to claim 26, characterized in that the central bolt (139;239;339;439), in the pretensioned position of the device and with its end located opposite the opening striker, is passed out through an opening from the housing so as to indicate the tension status.

28. A device according to any of claims 1, 12, 15 or 18, characterized in that the spring (121;221;321) is constructed in the form of a pressure spring and, when in the initial position, is supported on the shifting member (18;118;218;318) and on the tensioning member (122;222;322).

29. A device according to any of claims 8, 13, 20 or 15, characterized in that the chamber in the housing (10) accommodating the automatic element (35), is provided with a pressure balancing venting orifice and with a water entry aperture.

* * * * *

UNITED STATES PATENT AND TRADEMARK OFFICE

CERTIFICATE OF CORRECTION

PATENT NO. : 5,370,567

DATED : December 6, 1994

INVENTOR(S) : Stefan Glasa

It is certified that error appears in the above-identified patent and that said Letters Patent is hereby corrected as shown below:

In column 1, line 12, delete "and".

In column 7, line 49, after "drawing)" insert --,--.

In column 8, line 64, delete "18a" and insert --18--.

In column 9, line 49, delete "24" and insert --124--.

In column 10, line 40, delete "139" and insert --129--.

In column 12, line 23, delete "parallel" and insert --perpendicular--.

In column 14, line 57, delete "324" and insert --325--.

In column 14, line 61, delete "334" and insert --343--.

In column 15, line 27, delete "338a" and insert --328a--.

In column 17, line 45, delete "322" and insert --422--.

In column 17, line 58, delete "8a" and insert --9a--.

In column 17, line 62, delete "434a".

In column 18, line 68, delete "10d" and insert --10a--.

In column 19, line 16, delete "cove-ring" and insert --covering--.

UNITED STATES PATENT AND TRADEMARK OFFICE

CERTIFICATE OF CORRECTION

PATENT NO. : 5,370,567

DATED : December 6, 1994

INVENTOR(S) : Stefan Glasa

It is certified that error appears in the above-identified patent and that said Letters Patent is hereby corrected as shown below:

In column 19, line 53, delete "15b" and insert --415b--.

In column 28, line 18, delete "13,".

Signed and Sealed this

Eighteenth Day of April, 1995

Bruce Lehman

*Attest:*

BRUCE LEHMAN

*Commissioner of Patents and Trademarks*

*Attesting Officer*